US006170817B1

(12) United States Patent
Kawaguchi

(10) Patent No.: US 6,170,817 B1
(45) Date of Patent: Jan. 9, 2001

(54) SHEET FEEDING APPARATUS

(75) Inventor: Koichiro Kawaguchi, Yokohama (JP)

(73) Assignee: Canon Kabushiki Kaisha, Tokyo (JP)

( * ) Notice: Under 35 U.S.C. 154(b), the term of this patent shall be extended for 02 days.

(21) Appl. No.: 09/318,629

(22) Filed: May 26, 1999

(30) Foreign Application Priority Data

May 29, 1998 (JP) ..... 10-150435

(51) Int. Cl.[7] ..... B65H 1/00
(52) U.S. Cl. ..... 271/167; 271/171
(58) Field of Search ..... 271/167, 169, 271/171, 121

(56) References Cited

U.S. PATENT DOCUMENTS

| | | | | |
|---|---|---|---|---|
| 5,029,841 | * | 7/1991 | Ettischer et al. | 271/171 |
| 5,411,248 | * | 5/1995 | Yamaguchi | 271/171 |
| 5,938,190 | * | 8/1999 | Campbell et al. | 271/171 |
| 5,944,308 | * | 8/1999 | McLeod et al. | 271/171 |
| 6,059,281 | * | 5/2000 | Nakamura et al. | 271/121 |

FOREIGN PATENT DOCUMENTS 6-191650 7/1994 (JP) .

* cited by examiner

*Primary Examiner*—H. Grant Skaggs
(74) *Attorney, Agent, or Firm*—Fitzpatrick, Cella, Harper & Scinto

(57) ABSTRACT

The present invention provides a sheet feeding apparatus comprising a sheet stacking means for supporting a sheet, a sheet feeding means for feeding out the sheet supported by the sheet stacking means, a pair of side guides having sheet abutting surfaces for regulating both lateral edges of the sheet supported by the sheet stacking means to guide the sheet in a sheet feeding direction when the sheet is fed out from the sheet stacking means by the sheet feeding means, and a guide supporting means for supporting at least one of the pair of side guides for movement toward and away from the other side guide, and wherein the guide supporting means supports the side guide in such a manner that the sheet abutting surface is inclined with respect to the sheet feeding direction in accordance with a size of the sheet supported by the sheet stacking means.

20 Claims, 20 Drawing Sheets

SHEET FEEDING APPARATUS

BACKGROUND OF THE INVENTION

1. Field of the Invention

The present invention relates to a sheet feeding apparatus for feeding sheet one by one and an image forming apparatus having such a sheet feeding apparatus and adapted to record an image on the sheet sent from the sheet feeding apparatus.

2. Related Background Art

In the past, when a sheet is supplied to an image forming apparatus to be used therewith, sheets have been fed one by one by manual feeding or sheets have been fed by a sheet feeding apparatus automatically and continuously.

When the sheet are fed one by one automatically and continuously, the sheets are normally separated one by one by means of a claw separation system using a separation claw or a friction separation system utilizing friction between the sheet and a sheet stacking means.

In order to suppress skew-feeding during the sheet separation and sheet feeding, both lateral edges of the sheet is regulated by a pair of side guides provided on the sheet stacking means.

Further, in order to enhance the regulating ability of the pair of side guides, high friction members made of rubber or sponge or biasing members are adhered to portions of the side guides with which the sheet is contacted, or, as disclosed in Japanese Patent Application Laid-Open No. 6-191650, projections are provided on the side guides.

However, the conventional sheet feeding apparatuses have the following drawbacks:

(1) In the apparatus in which the high friction members or the biasing members are adhered to the side guides, when the sheet is fed and conveyed, sliding resistance between the sheet and the side guides becomes great, which may result in skew-feeding or sheet jam.

(2) In the apparatus in which the projections are provided on the side guides, when a thick sheet such as a post card is regulated, the sheet cannot enter between the projections to create gaps between the sheet and the side guides, thereby worsening the regulating effect. Further, abutting positions between the side guides and the sheet may be changed whenever the operator manipulates the side guides, with the result that the skew-feeding cannot be prevented effectively.

SUMMARY OF THE INVENTION

The present invention aims to eliminate the above-mentioned conventional drawbacks, and an object of the present invention is to provide a sheet feeding apparatus which can correctly regulate lateral edges of a sheet regardless of the operator's manipulation, and an image forming apparatus having such a sheet feeding apparatus and adapted to record an image on the sheet sent from the sheet feeding apparatus.

To achieve the above object, according to the present invention, there is provided a sheet feeding apparatus comprising sheet stacking means for supporting sheets, sheet feeding means for feeding out the sheet supported by the sheet stacking means, a pair of side guides having sheet abutment surfaces for regulating both lateral edges of the sheet supported by the sheet stacking means to guide the sheet in a sheet feeding direction when the sheet is fed out from the sheet stacking means by the sheet feeding means, and guide supporting means for supporting at least one of the pair of side guides for movement toward and away from the other side guide, and the guide supporting means supports the side guide in such a manner that the sheet abutment surface is inclined with respect to the sheet feeding direction in accordance with a size of the sheet supported by the sheet stacking means.

The present invention further provides a sheet feeding apparatus comprising sheet stacking means for supporting sheets, sheet feeding means for feeding out the sheet supported by the sheet stacking means, a pair of side guides having sheet abutment surfaces for regulating both lateral edges of the sheet supported by the sheet stacking means to guide the sheet in a sheet feeding direction when the sheet is fed out from the sheet stacking means by the sheet feeding means, and guide supporting means for supporting at least one of the pair of side guides for movement toward and away from the other side guide, and the guide supporting means supports the side guide in such a manner that the side guide is shifted in accordance with a size of the sheet supported by the sheet stacking means, and, in a position where the side guides are spaced apart, downstream ends of the abutment surfaces in the sheet feeding direction are inclined toward a sheet abutting direction, and, in a position where the side guides are approached, upstream ends of the abutment surfaces in the sheet feeding direction are inclined toward the sheet abutting direction.

DESCRIPTION OF THE PREFERRED EMBODIMENTS

Now, first, second and third embodiments of the present invention will be explained with reference to FIGS. 1 to 19, FIG. 20, and FIGS. 21 and 22, respectively. Incidentally, numerical values used in the embodiments are merely exemplary and do not limit the present invention.

Figure 13:
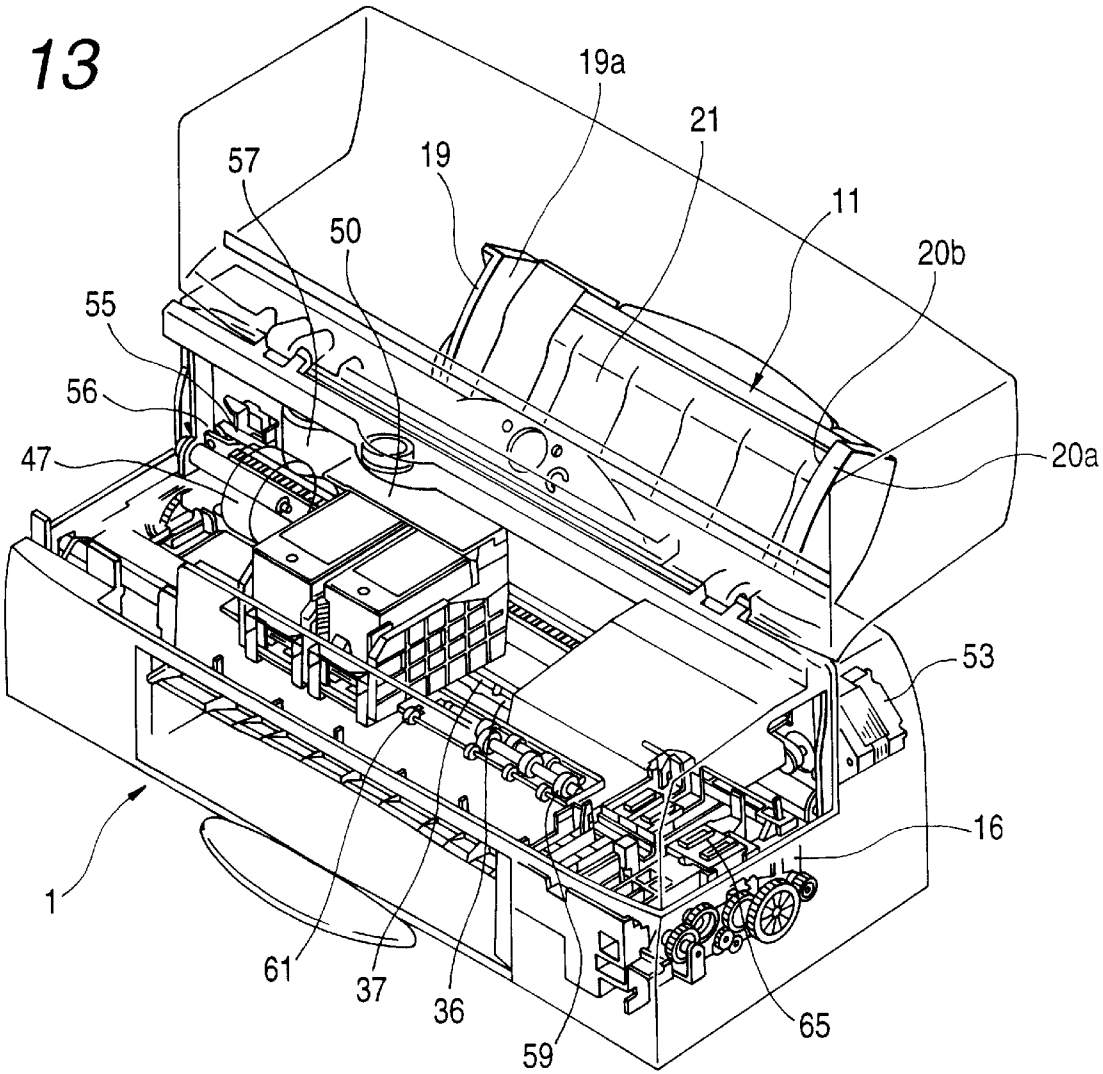
FIG. 13 is a perspective view of a printer showing a condition that a cover is opened.
Figure 14:
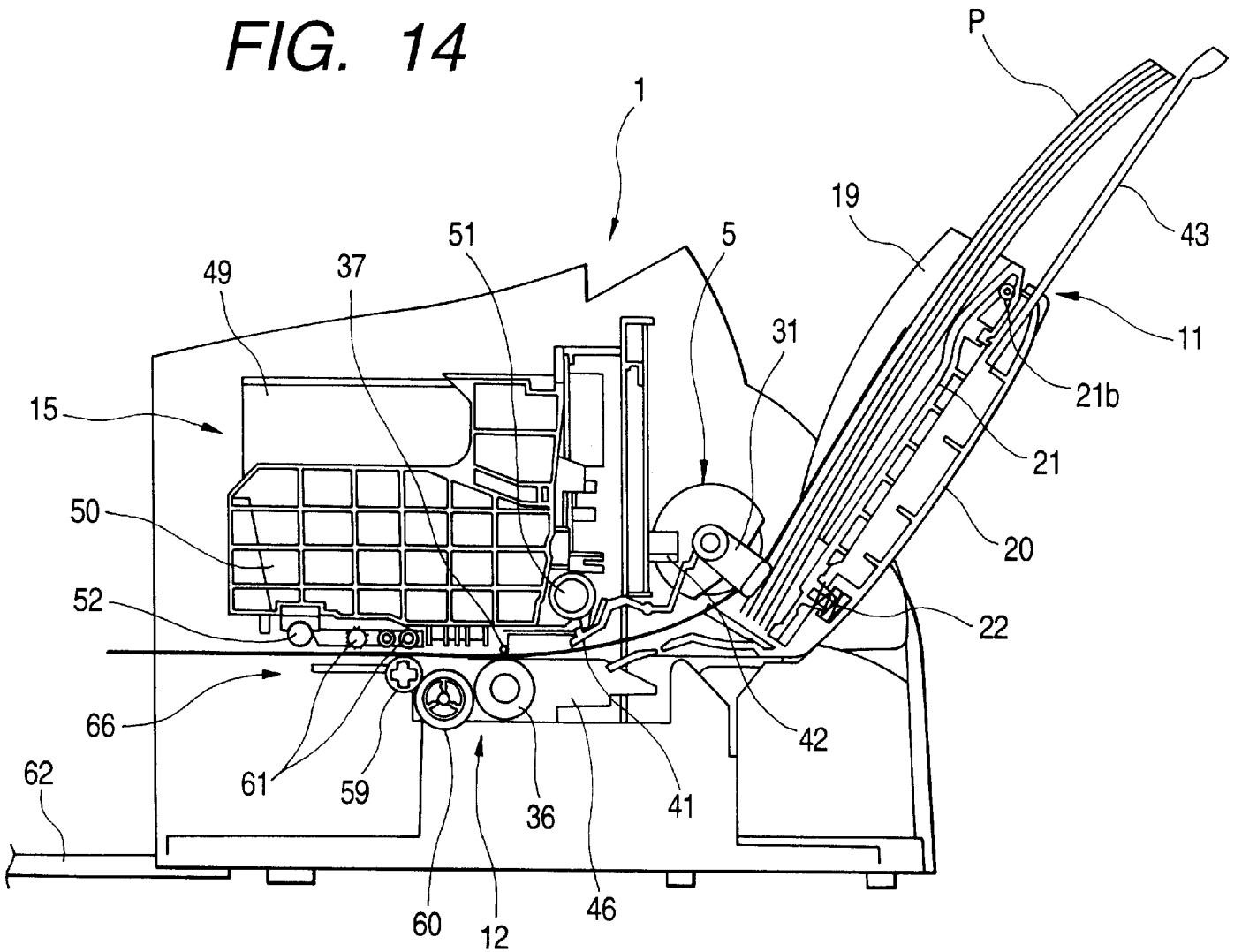
FIG. 14 is a sectional view of the printer.

Each of sheet feeding apparatuses according to the first to third embodiments is incorporated into an image forming apparatus 1 shown in FIGS. 13 and 14. Thus, the image forming apparatus 1 includes a sheet conveying portion 12, a carriage portion 15, a cleaning portion 16 and a sheet discharging portion 66, as well as the sheet feeding apparatus 11.

FIG. 13 is a perspective view of the entire image forming apparatus, and FIG. 14 is a sectional view of the image forming apparatus.

In FIGS. 13 and 14, a pressure plate 21 of the sheet feeding apparatus 11 is attached to a main body of the image forming apparatus at an angle of about 30 to 60 degrees with respect to an installation surface of the image forming apparatus 1. Recording sheets (sheets) P set in the sheet feeding apparatus 11 are discharged horizontally after image formation.

Figure 15:
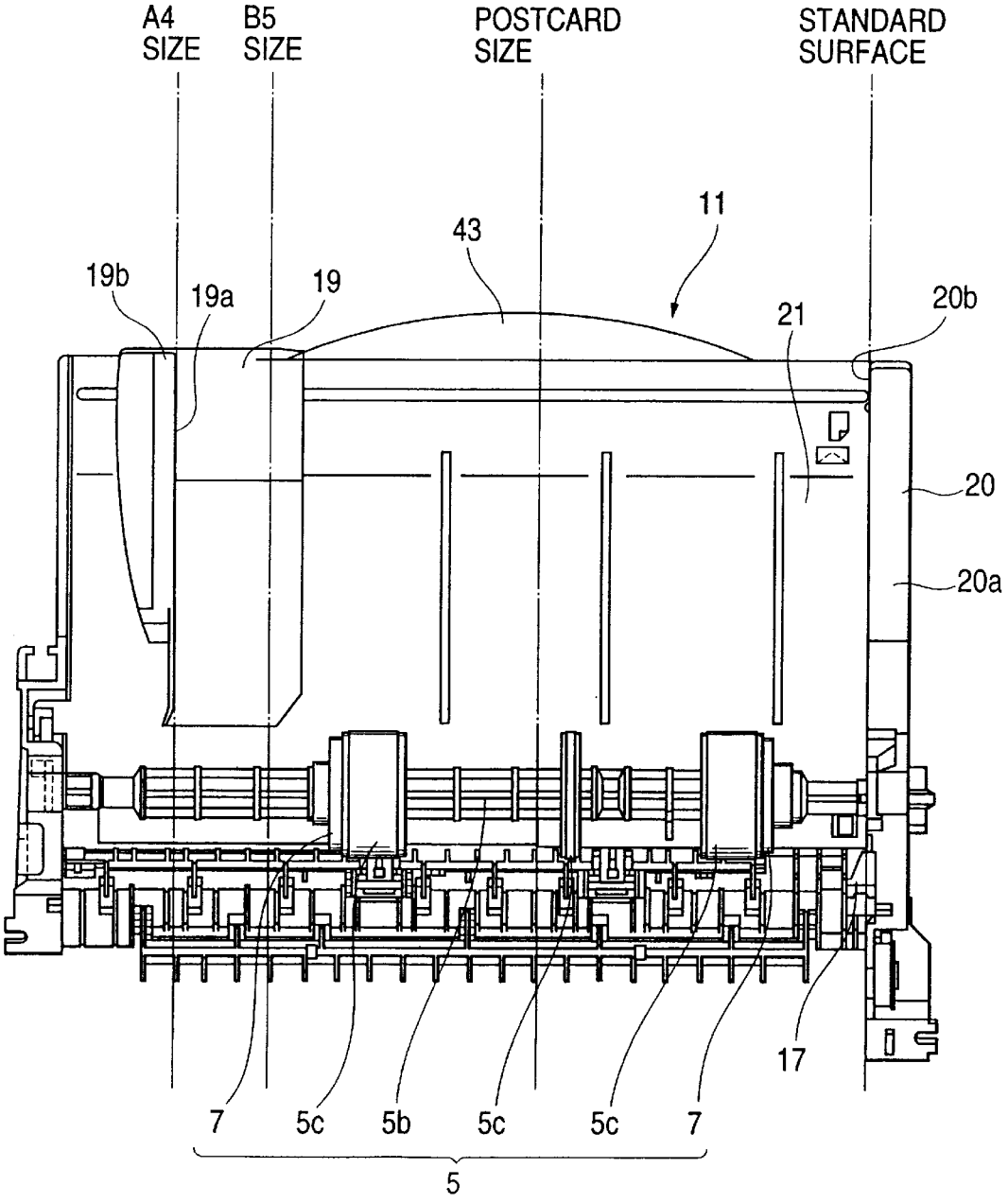
FIG. 15 is a front view of the sheet feeding apparatus of FIG. 1 to explain a sheet feeding roller.
Figure 16:
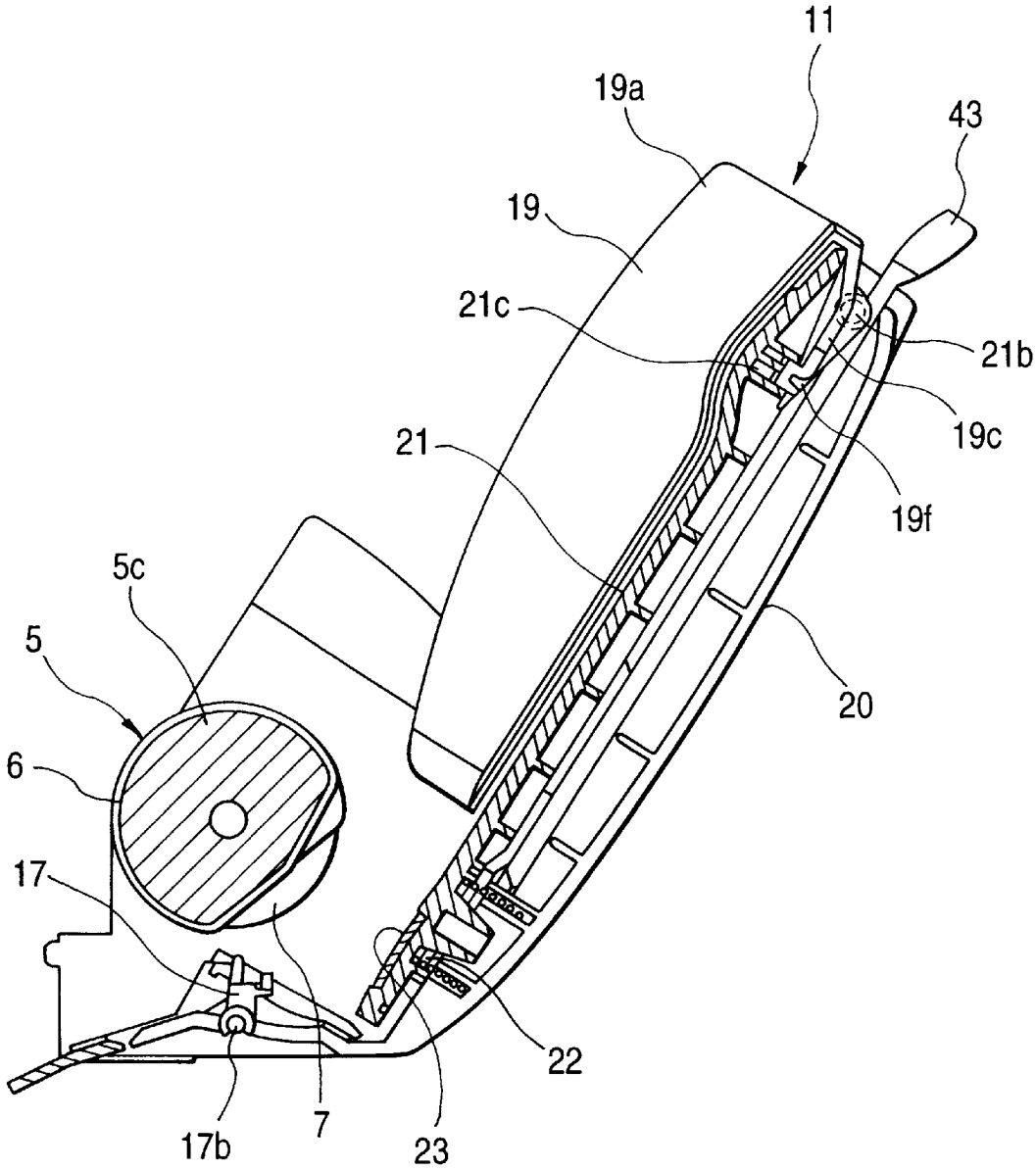
FIG. 16 is a sectional view of the sheet feeding apparatus.

As shown in FIGS. 15 and 16, the sheet feeding apparatus 11 comprises a sheet feeding roller (sheet feeding means) 5, a separation claw 17, a movable side guide 19, a base 20, a pressure plate 21, a pressure plate spring 22, and a sheet feeding cam 31. Normally, since the pressure plate 21 is lowered by the sheet feeding cam via a cam follower (not shown) provided on the pressure plate 21, the recording sheet P is spaced apart from the sheet feeding roller 5.

In a condition that the recording sheets P are set, when the sheet feeding cam 31 and the sheet feeding roller 5 are rotated by driving a paper feed motor 47 driven in response to sheet feed command, the sheet feeding cam 31 is separated from the pressure plate 21, with the result that the pressure plate 21 is lifted by the pressure plate spring 22, thereby pressure-contacting the recording sheet P with the sheet feeding roller 5. The recording sheets P are picked up by rotation of the sheet feeding roller 5 and are separated one by one by the separation claw 17. The separated recording sheet P is sent to the sheet conveying portion 12.

The sheet feeding roller 5 and the sheet feeding cam 31 are rotated by one revolution until they feed the recording sheet P into the conveying portion 12, and, thereafter, the pressure plate 21 is spaced apart from the sheet feeding roller 5 again. At the same time, transmission of the driving force from the motor 47 to the sheet feeding roller 5 is interrupted to bring the sheet feeding apparatus 11 to an initial condition.

The sheet conveying portion 12 includes a conveying roller 36, a pinch roller 37, a PE sensor lever 41, a PE sensor 42 and a platen 46.

The recording sheet P sent to the sheet conveying portion 12 is guided by the platen 46 to enter into a nip between the conveying roller 36 and the pinch roller 37. A leading end of the recording sheet P is detected by the PE sensor lever 41 disposed in front of the pair of rollers 36, 37, thereby determining a recording position on the recording sheet P.

The recording sheet P sent to the nip between the pair of rollers 36, 37 is advanced along the platen 46 by the pair of rollers 36, 37 rotated by the paper feed motor 47; meanwhile, recording (image formation) is effected by a recording head 49 on the basis of predetermined image information.

The recording head 49 is integrally formed with an ink tank to provide a replaceable ink jet recording head. The recording head includes electrical converters so that the recording is effected by discharging ink from discharge openings by utilizing change in pressure caused by thermal energy applied.

The carriage portion 15 includes a carriage 50 on which the recording head 49 is mounted, a guide shaft 51 for reciprocally scanning and guiding the carriage in a direction perpendicular to a recording sheet conveying direction, an auxiliary guide 52 for supporting a tip end of the carriage to maintain a distance or gap between the head and the recording sheet, a timing belt 55 for transmitting a driving force of a carriage motor 53 to the carriage 50, an idler pulley 56 for giving tension to the timing belt 55, a flexible substrate 57 for transmitting a head drive signal from an electrical substrate to the recording head 49, and the like. By scanning the recording head 49 and the carriage 50 integrally or simultaneously, an image can be formed on the recording sheet P conveyed onto the platen 46.

The sheet discharging portion 66 includes a sheet discharging roller 59, a transmission roller 60 for transmitting the driving force of the conveying roller 36 to the sheet discharging roller 59, and spur rollers 61 for aiding the sheet discharging. The recording sheet P on which the image was formed is discharged onto a sheet discharge tray 62 by the sheet discharging roller 59 and the spur rollers 61.

The cleaning portion 16 includes a cap 65 for preventing drying of the recording head, and a tube pump (not shown) for cleaning the recording head 49.

Next, the sheet feeding apparatus according to the present invention will be fully explained with reference to FIGS. 15 and 16. FIG. 15 is a front view of the sheet feeding apparatus 11, and FIG. 16 is a detailed sectional view of the sheet feeding apparatus.

The sheet feeding apparatus 11 is unitized by attaching various parts to a base 20. The sheet feeding apparatus 11 utilizes one side reference of the recording sheet P. To this end, an inner surface of a fixed side guide 20*a* protruded from the base 20 at the right thereof defines a reference surface 20*b* for regulating a width-wise direction of the sheet. A sub tray 43 can be retracted into the base 20, and, when recording sheets P having relatively large size are stacked on the pressure plate 21, the sub tray is extended to support the rear surfaces of the recording sheets.

The pressure plate 21 is connected to the base 20 via pressure plate shafts 21*b* at its upper both ends for rotational movement around the pressure plate shafts 21*b*. Between the pressure plate 21 and the base 20, the pressure plate spring 22 is disposed substantially in a confronting relation to a roller portion 5*c* of the sheet feeding roller 5. A separation pad 23 made of synthetic leather having relatively large coefficient of friction is provided on an upper surface of the pressure plate 21 opposed to the sheet feeding roller 5, thereby preventing double-feeding and the like of the recording sheets P when the remaining number of the sheets becomes few.

A movable side guide 19 slidable in a left-and-right direction in FIG. 15 is attached onto the pressure plate 21 to align recording sheets P having various sizes along the reference surface 20*b*.

Figure 17:
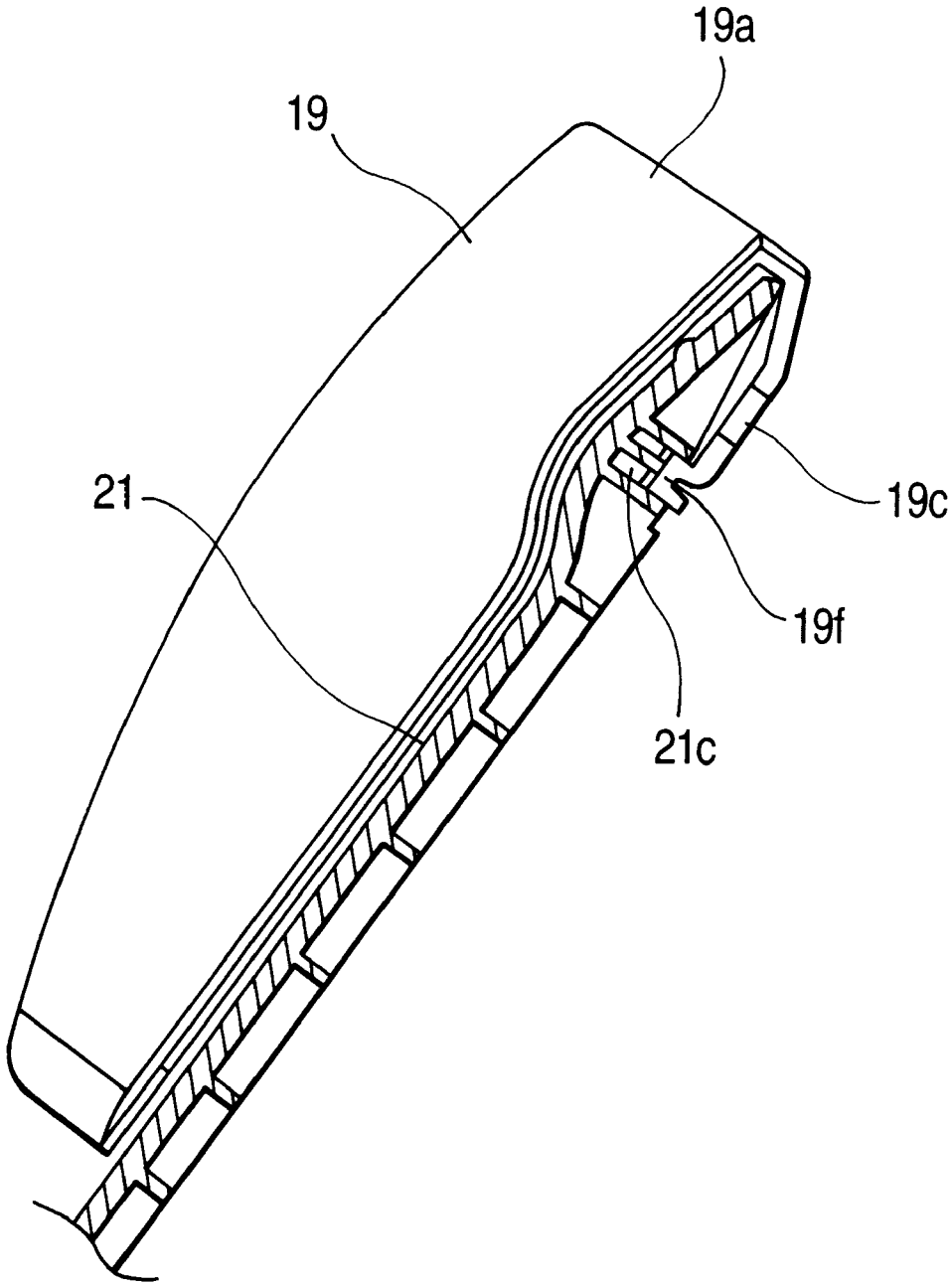
FIG. 17 is a sectional view showing a condition that the movable side guide is incorporated into the pressure plate.

In FIG. 17, a slider 19*f* integrally formed with the side guide 19 is attached to the side guide 19 to urge a rail 21*c* of the pressure plate 21 by an elastic force of a clip 19*c* thereby to pinch the pressure plate 21 between the slider and the side guide so that the side guide 19 is shifted in the left-and-right direction along the rail 21*c*. The rail 21*c* of the pressure plate 21 extends in a direction perpendicular to the recording sheet feeding direction. The side guide 19 is provided with a grip 19*b* through which the operator manipulates the side guide. A sliding force for sliding the side guide 19 in the left-and-right direction is selected to about 350 to 1200 grams. The operator (user) can regulate the width-wise direction of the recording sheets P by abutting a recording sheet abutting surface 19*a* of the side guide against lateral edges of the recording sheets P.

Figure 3:
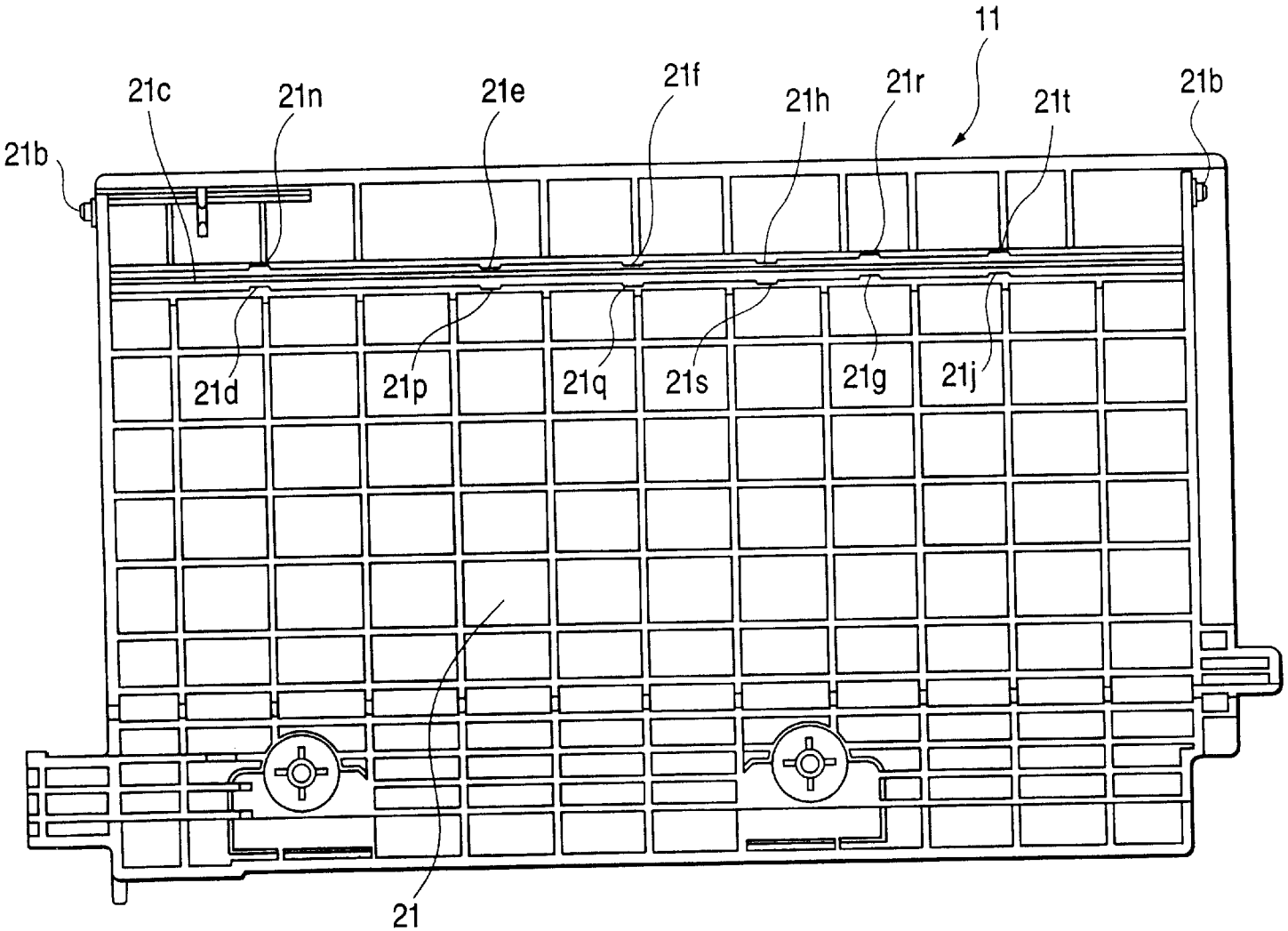
FIG. 3 is a rear view of a pressure plate of FIG. 1.
Figure 4:
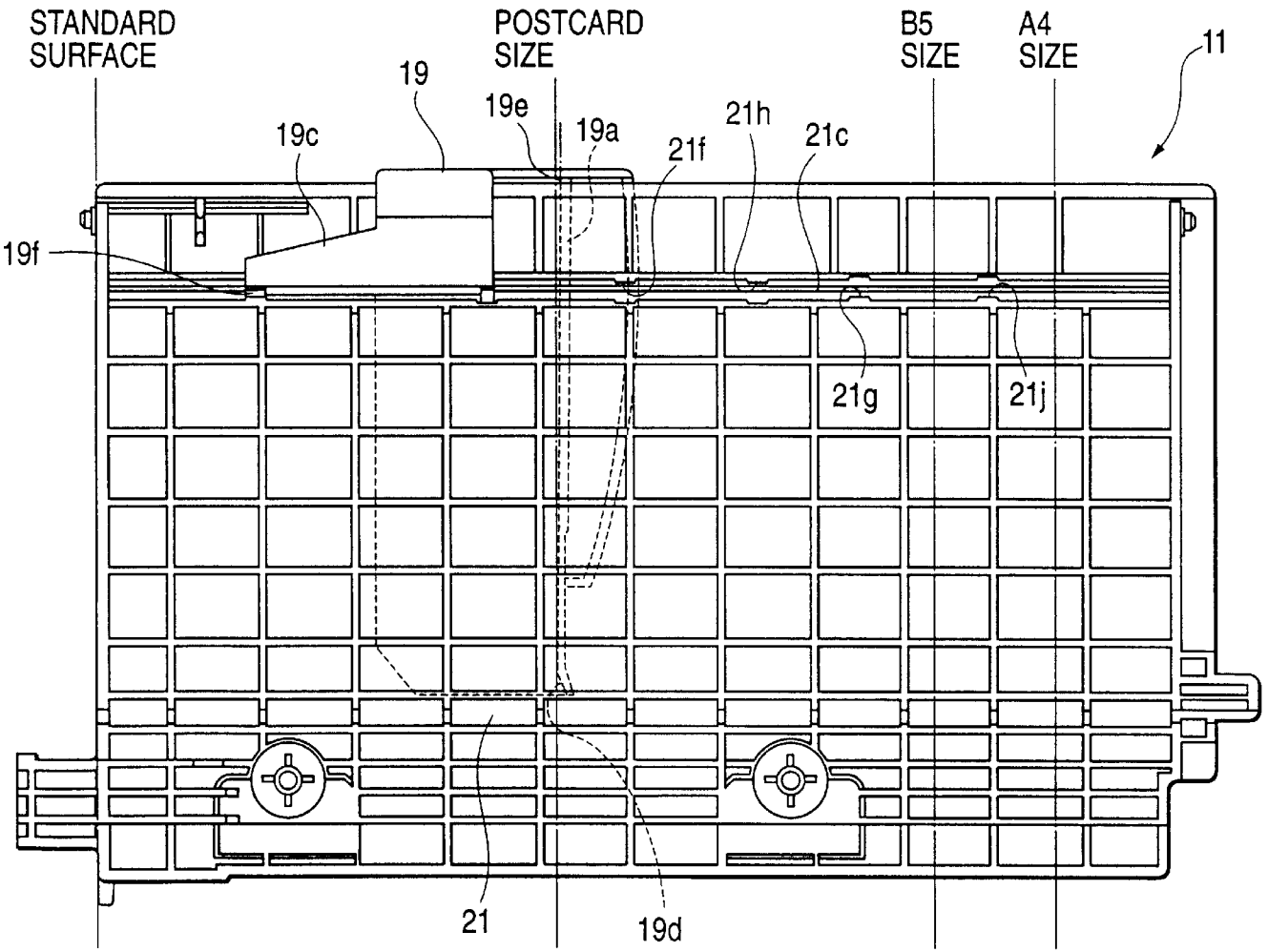
FIG. 4 is a rear view of a pressure plate having a movable guide guiding a post card.

FIG. 3 is a rear view of the pressure plate 21 and FIG. 4 is a rear view of the pressure plate 21 into which the side guide 19 is incorporated.

The rail 21*c* is provided with protruded portions 21*d* to 21*g* and 21*j* and recessed portions 21*n* and 21*p* to 21*t* in correspondence with positions where recording sheets having post card size, B5 size and A4 size are regulated respectively by the movable side guide 19. Functions of the protruded portions and the recessed portions will be described later.

Figure 1:
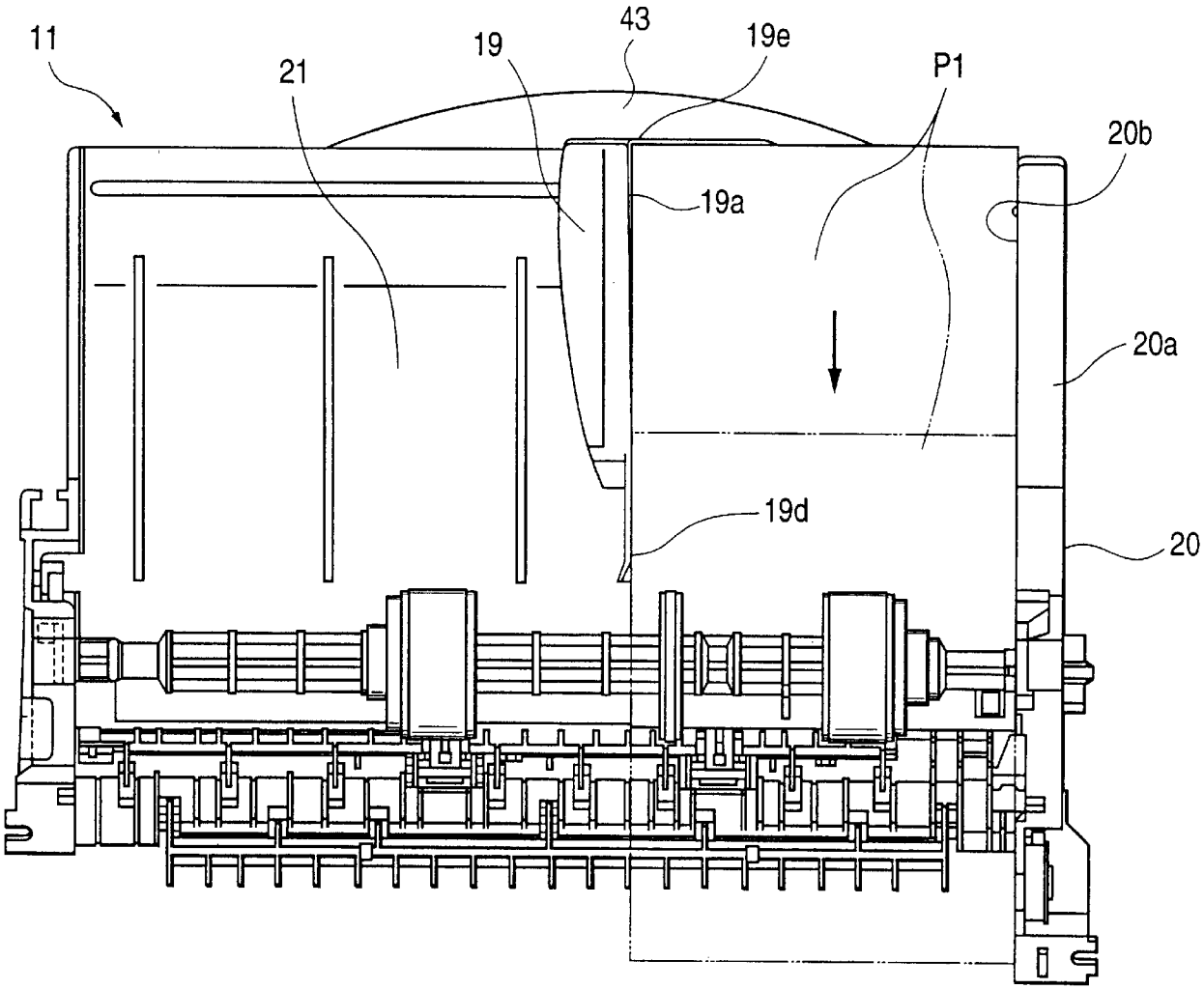
FIG. 1 is a front view of a sheet feeding apparatus according to a first embodiment of the present invention, showing a condition that a tip end (downstream end) of a movable guide abuts against a post card to regulate the post card in a width-wise direction.
Figure 2:
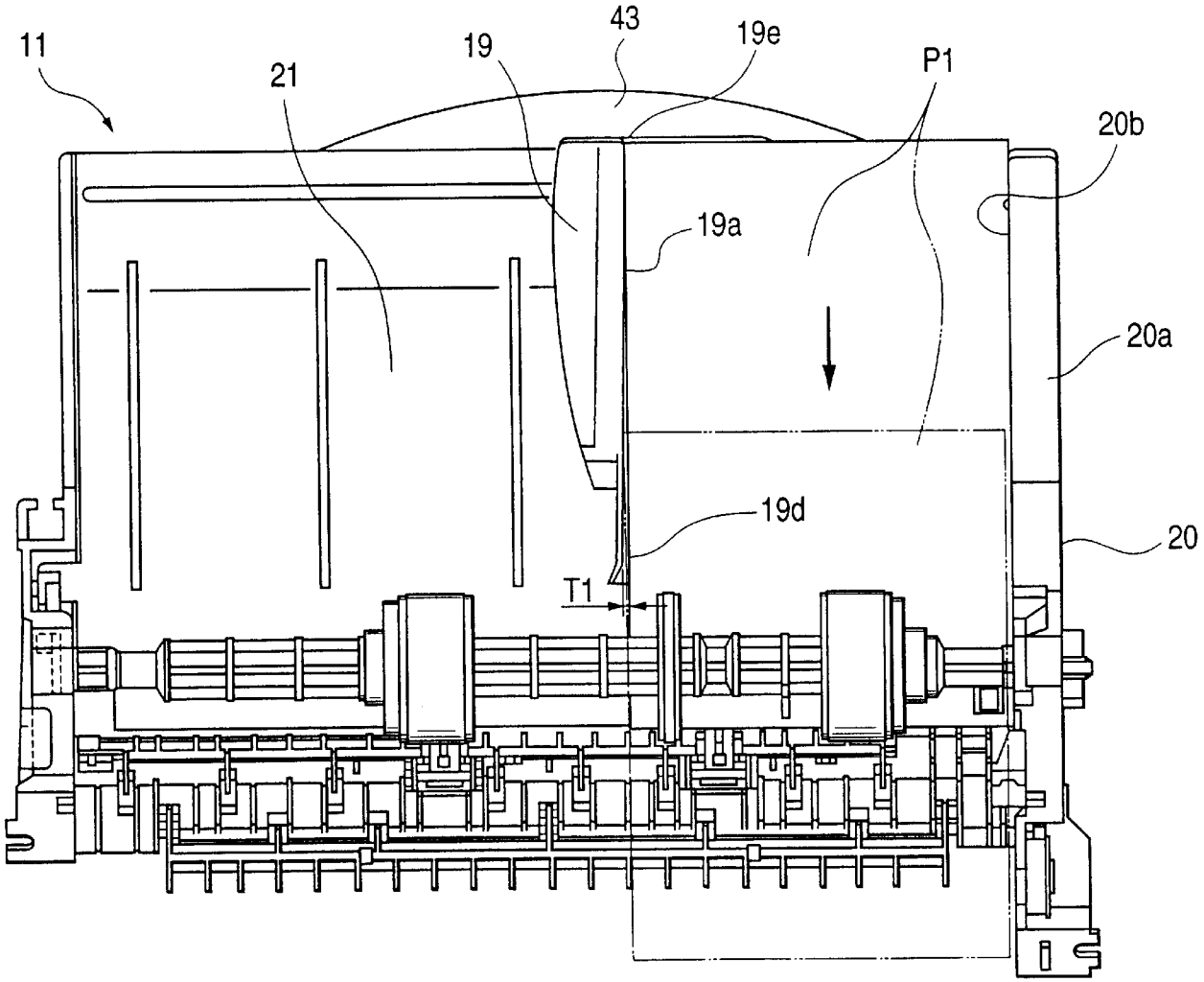
FIG. 2 is a front view of the sheet feeding apparatus according to the first embodiment, showing a condition that a tail end (upstream end) of the movable guide abuts against the post card to regulate the post card in the width-wise direction.
Figure 9:
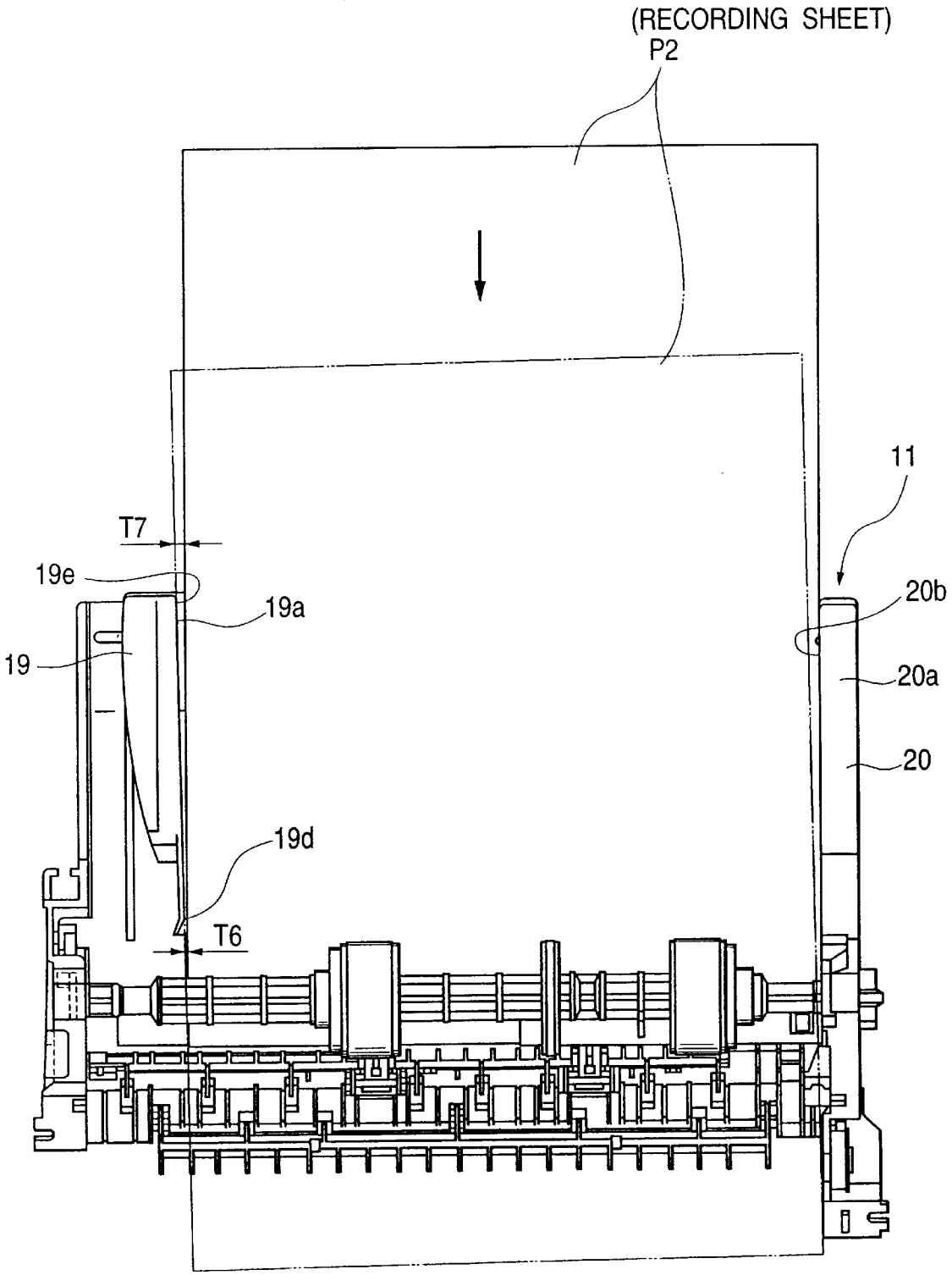
FIG. 9 is a view showing a condition that a tip end portion (downstream end portion) of the movable side guide approaches to a recording sheet having A4 size more than a tail end portion (upstream end portion) of the movable side guide to guide the recording sheet, in the sheet feeding apparatus of FIG. 1.
Figure 10:
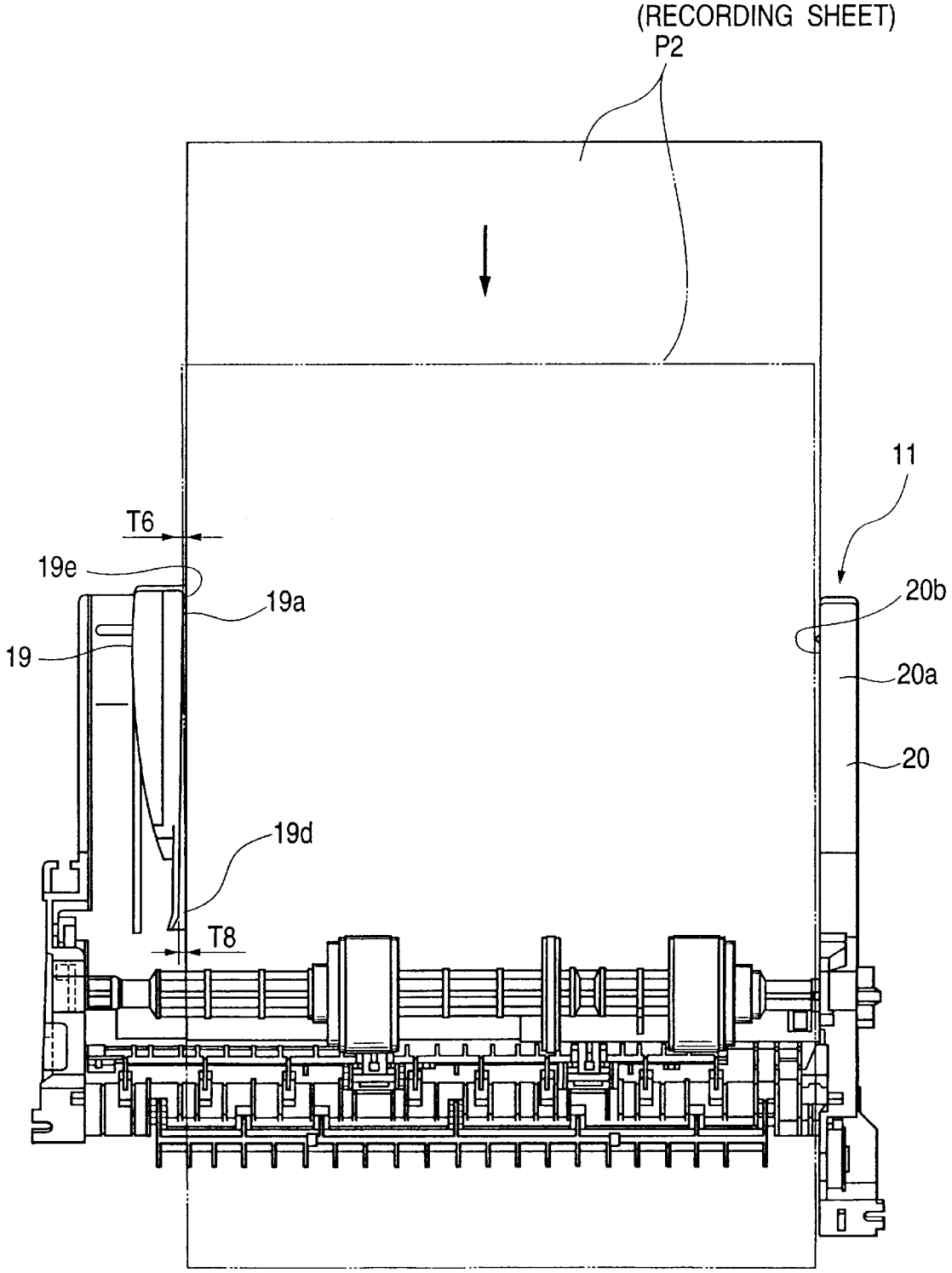
FIG. 10 is a view showing a condition that the tail end portion (upstream end portion) of the movable side guide approaches to the recording sheet having A4 size more than the tip end portion (downstream end portion) of the movable side guide to guide the recording sheet, in the sheet feeding apparatus of FIG. 1.

A certain gap is created between the slider 19*f* of the movable side guide 19 and the rail 21*c* to set the sliding force for sliding the movable side guide 19 in the left-and-right direction within the optimum range between about 350 grams and about 1200 grams. However, when the operator abuts the recording sheet abutting surface 19*a* of the movable side guide 19 against the lateral edges of the recording sheets P, due to the above-mentioned gap, a tip end portion (downstream end portion) 19*d* of the movable side guide 19 in the recording sheet feeding direction may abut against the lateral edges of the recording sheets P as shown in FIGS. 1 and 9, or a tail end portion (upstream end portion) 19*e* of the movable side guide 19 in the recording sheet feeding direction may abut against the lateral edges of the recording sheets P as shown in FIGS. 2 and 10. Thus, very courteous handling is required for closely contacting the entire recording sheet abutting surface 19*a* of the movable side guide 19 against the lateral edges of the recording sheets P.

By the way, when a post card P1 is longitudinally set on the sheet feeding apparatus 11, since the post card P1 is relatively short in the recording sheet feeding direction, as shown in FIG. 2, if the tail end portion 19*e* of the movable side guide 19 abuts against the lateral edge of the post card, a gap T1 will be created between the tip end portion 19*d* of the movable side guide 19 and the lateral edge of the post card P1. In this case, regulation of the movable side guide 19 for the post card P1 becomes insufficient before a leading end of the post card P1 is pinched between the pinch roller 37 and the conveying roller 36, thereby causing the skew-feeding of the recording sheet P (as shown by the two dot and chain line).

On the other hand, as shown in FIG. 1, if the tip end portion 19*d* of the movable side guide 19 abuts against the lateral edge of the post card P1, the movable side guide 19 abuts against the lateral edge of the post card P1 until the leading end of the post card P1 is pinched between the pinch roller 37 and the conveying roller 36, thereby achieving efficient regulating effect of the movable side guide 19 for the post card P1.

Figure 5:
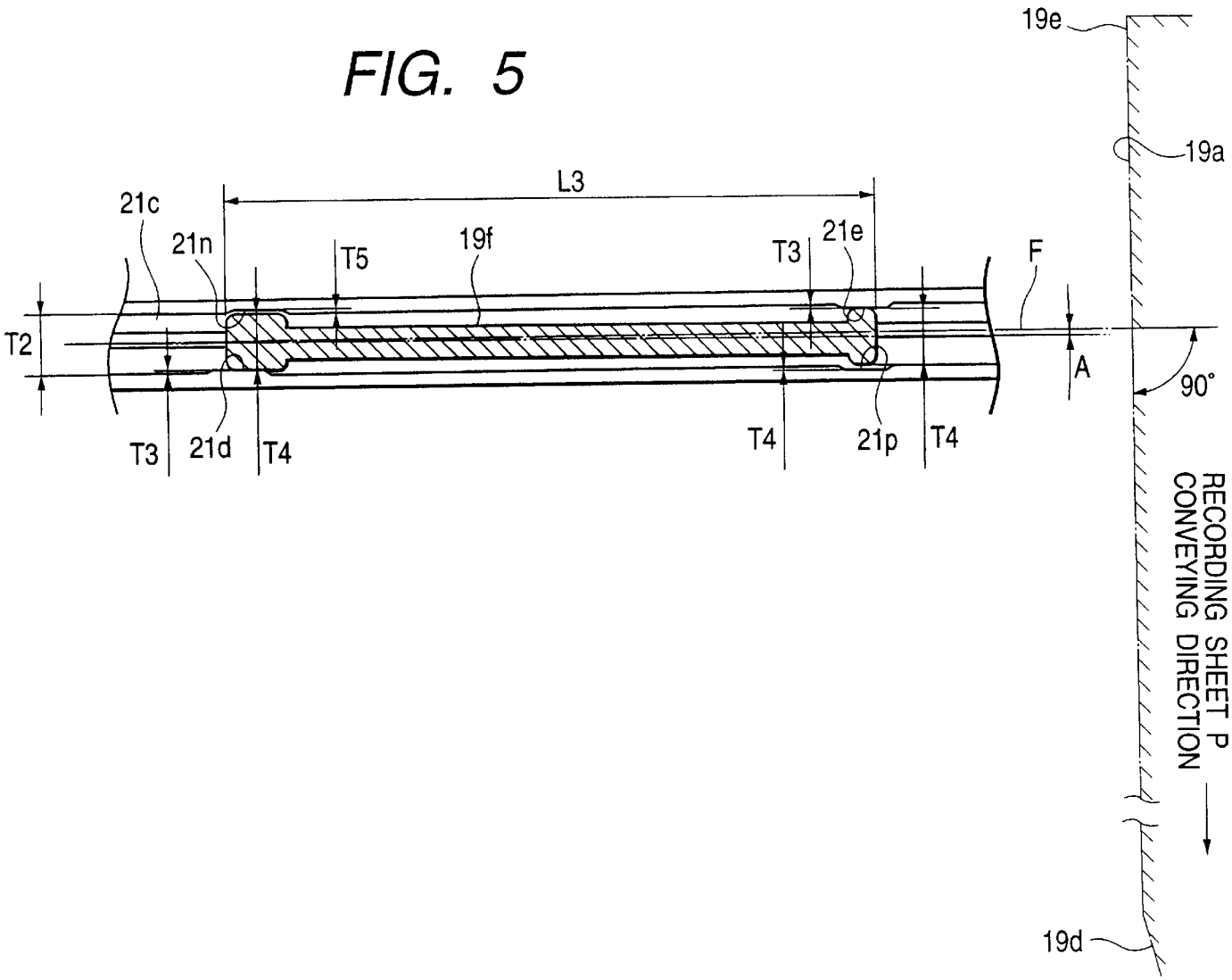
FIG. 5 is an enlarged view showing a condition that a slider (shown in section) is engaged by a rail in FIG. 4.
Figure 6:
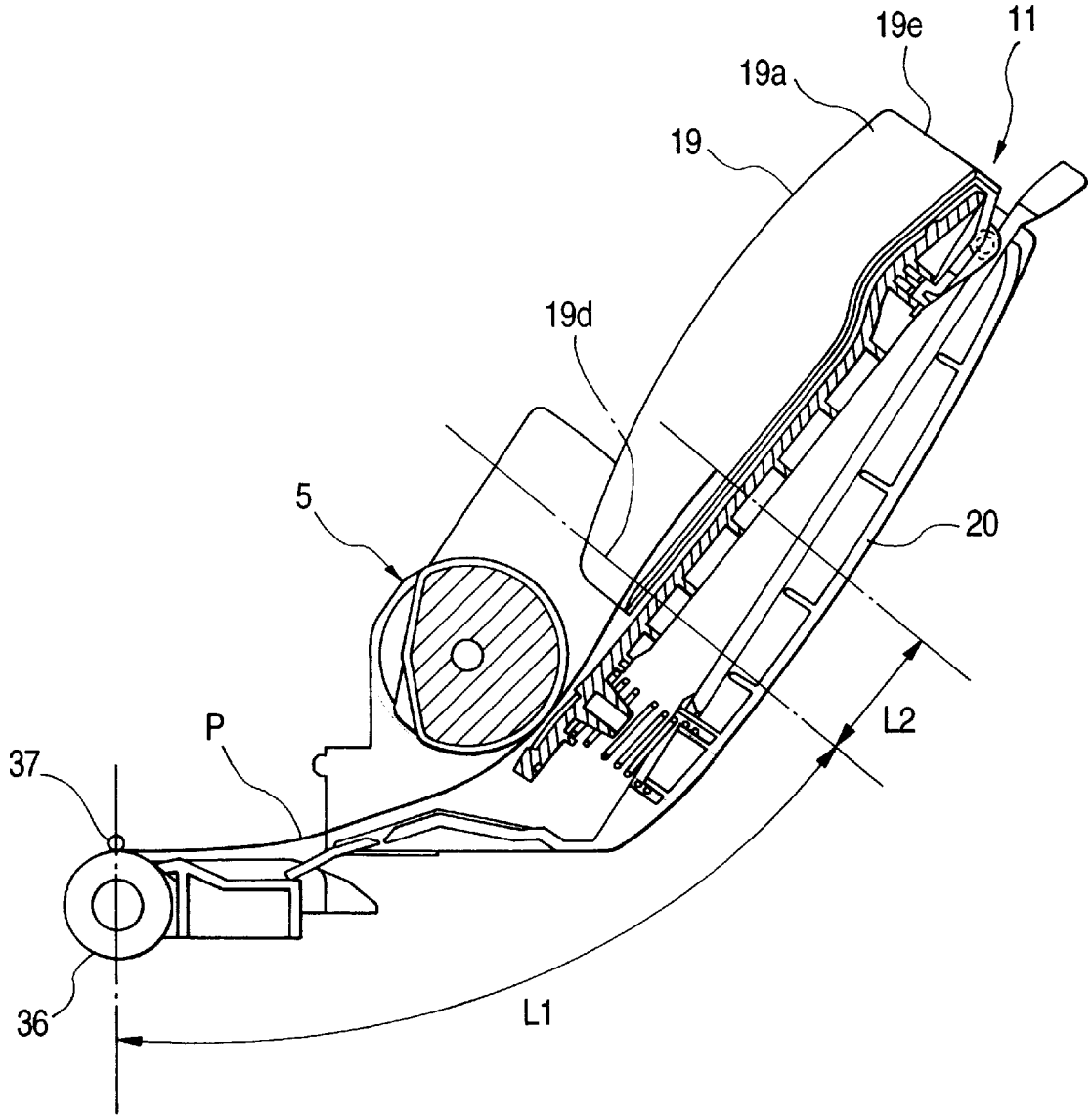
FIG. 6 is a sectional view of the sheet feeding apparatus of FIG. 1.

FIGS. 5 and 6 are views showing a positional relationship and a length relationship between the movable side guide 19 and the pinch roller 37 and the like in the recording sheet feeding direction, in the illustrated embodiment.

In FIG. 6, L1 is a length of a sheet path from the nip between the pinch roller 37 and the conveying roller 36 to the tip end portion 19*d* of the side guide and is selected to about 123 mm in the illustrated embodiment. Since the length of the post card P1 is 148 mm, when the leading end of the post card reaches the pinch roller 37, the trailing end of the post card P1 is located at a distance L2 (=25 mm) from the tip end portion 19*d*. Thus, as mentioned above, when the tip end portion 19*d* abuts against the lateral edge of the post card P1, the efficient regulating effect of the movable side guide 19 for the post card P1 is achieved, thereby preventing the skew-feeding.

The protruded portions 21*d*, 21*e* (provided on the pressure plate 21) for the post card ensure that the tip end portion 19*d* of the movable side guide 19 abuts against the lateral edge of the post card P1 without fail when the movable side guide 19 is shifted to the feeding position for the post card P1. The recessed portions 21*n*, 21*p* for the post card are opposed to the protruded portions 21*d*, 21*e*. Thus, the presence of the protruded portions 21*d*, 21*e* do not increase the sliding force of the movable side guide 19.

FIG. 4 is a rear view showing a positional relationship between the movable side guide 19 and the pressure plate 21 when the post card P1 is guided. FIG. 5 is a sectional view showing a relationship between the slider 19*f* and the protruded and recessed portions in this case. The slider 19*f* is shown as a sectional view.

In FIG. 4, since a width T2 of the rail 21*c* is selected to 4.8 mm and a width T4 of the slider 19*f* is selected to 4.5 mm and a length L3 of the slider is selected to 54 mm, if there are no protruded portions 21*d*, 21*e*, the slider 19*f* will be inclined by about ±0.3 degree at the maximum with respect to a line F (FIG. 5) perpendicular to the recording sheet conveying direction. That is to say, the recording sheet abutting surface 19*a* is inclined by about ±0.3 degree at the maximum with respect to the recording sheet conveying direction.

Figure 7:
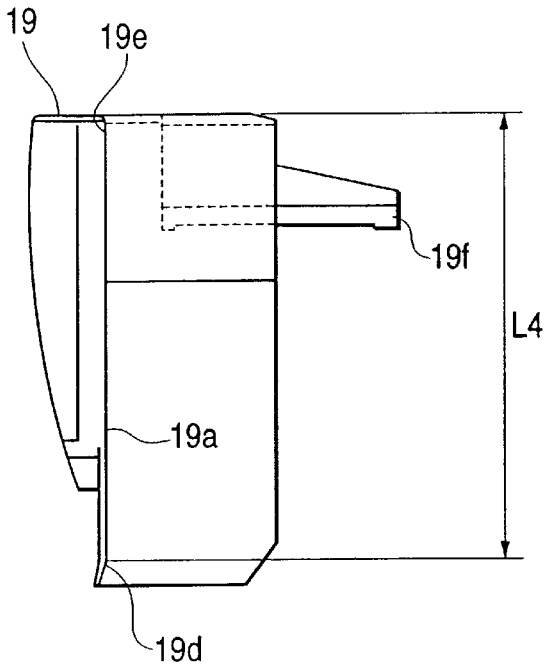
FIG. 7 is a front view of the side guide.
Figure 8:
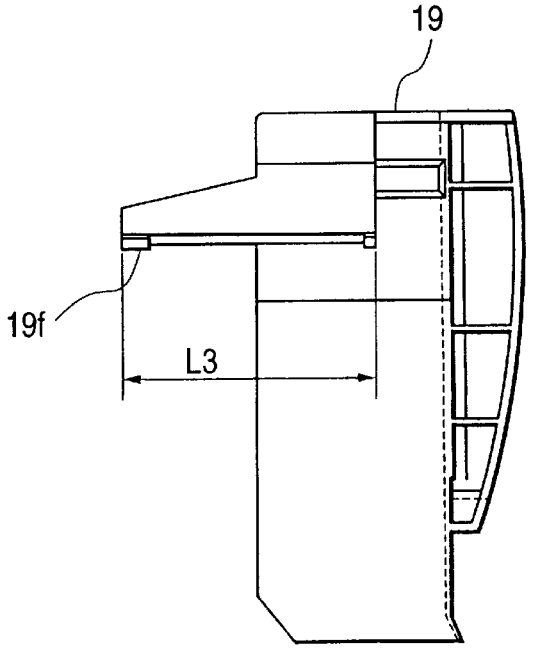
FIG. 8 is a rear view of the side guide.

FIG. 7 is a front view of the movable side guide 19 and FIG. 8 is a rear view of the movable side guide 19. Since a length L4 of the recording sheet abutting surface is selected to 106 mm, as mentioned above, depending upon the operator's manipulation, a gap T1 becomes about 0.6 mm at the maximum at the tip end portion 19*d* as shown in FIG. 2, with the result that the regulating effect of the movable side guide 19 cannot be achieved efficiently.

To avoid this, in the illustrated embodiment, the protruded portions 21*d*, 21*e* for the post card are provided so that the entire movable side guide 19 is rotated slightly in an anti-clockwise direction in FIG. 1 via the slider 19*f* regardless of the operator's manipulation to incline the recording sheet abutting surface 19*a* only in one direction. That is to say, the movable side guide 19 can be inclined with respect to the recording sheet conveying direction.

In the illustrated embodiment, since a protruded amount T3 of each of the protruded portions 21*d*, 21*e* is selected to 0.3 mm and a recessed amount of each of the recessed portions 21*p*, 21*n* is selected to 0.3 mm, the slider 19*f* and accordingly the recording sheet abutting surface 19*a* are inclined by an angle A (FIG. 5) of about 0.1 to about 0.5 degree toward a direction along which the tip end portion 19*d* abuts against the lateral edge of the post card P1, with the result that, regardless of the operator's manipulation, the efficient regulating effect of the movable side guide 19 can be achieved, thereby preventing the skew-feeding of the post card.

When a recording sheet having B5 size or A4 size is longitudinally set on the sheet feeding apparatus 11, since a length of the recording sheet having B5 size or A4 size in the recording sheet feeding direction is relatively great (B5 =257 mm, A4 =297 mm), even when either the tip end portion 19*d* or the tail end portion 19*e* of the movable side guide 19 abuts against the lateral edge of the recording sheet, a portion of the recording sheet abutting surface 19*a* of the movable side guide 19 continues to abut against the lateral edge of the recording sheet until a leading end of the recording sheet P is pinched between the pinch roller 37 and the conveying roller 36. However, if any gap is created between the recording sheet abutting surface 19*a* and the lateral edge of the recording sheet P, the skew-feeding preventing effect is more enhanced when the tip end portion 19*d* abuts against the recording sheet P.

As is in the post card, if the rail has no protruded portions, the recording sheet abutting surface 19*a* is inclined by about ±0.6 degree at the maximum in the recording sheet P conveying direction. As shown in FIG. 9, for example, if a gap T6 of 0.5 mm is created between the recording sheet abutting surface 19*a* and the lateral edge of the recording sheet P2 having A4 size and the recording sheet abutting surface 19*a* is inclined toward a direction along which the tail end portion 19*e* is separated away from the lateral edge of the recording sheet P2, by adding the inclined amount to the gap T6, a gap T7 between the tail end portion 19*e* and the lateral edge of the recording sheet P2 becomes about 1.1 mm to increase the gap.

Further, as shown in FIG. 10, if the recording sheet abutting surface 19*a* is inclined toward a direction along which the tip end portion 19*d* is separated away from the lateral edge of the recording sheet P2, similarly, a gap T8 between the tip end portion 19*d* and the lateral edge of the recording sheet P2 becomes about 1.1 mm to increase the gap. However, since the tail end portion 19*e* abuts against the lateral edge of the recording sheet P, the gap T8 does almost not contribute to occurrence of the skew-feeding of the recording sheet.

That is to say, the cause of the skew-feeding is only the gap T6 of 0.5 mm. This is true when the recording sheet having B5 size is fed. Namely, in case of recording sheets having relatively great length in the recording sheet conveying direction such as the recording sheets having B5, A4 sizes, it is said that the skew-feeding is more prevented when the tail end portion 19*e* abuts against the lateral edge of the recording sheet.

Thus, in the illustrated embodiment, the protruded portions 21*f*, 21*g* for the recording sheet having B5 size and the protruded portions 21*h*, 21*j* for the recording sheet having A4 size are provided on the rail 21*c* of the pressure plate 21 so that the trail end portion 19*e* of the movable side guide 19 abuts against the lateral edge of the recording sheet P2 without fail when the movable side guide 19 is shifted to the feeding position for the recording sheet having B5 size or A4 size, as shown in FIG. 3. Since the recessed portions (recessed portions 21*q*, 21*r* for the recording sheet having B5 size and recessed portions 21*s*, 21*t* for the recording sheet having A4 size) are provided in a confronting relation to the respective protruded portions, similar to the post card, the protruded portions can provide the optimum sliding force for the side guide.

Figure 11:
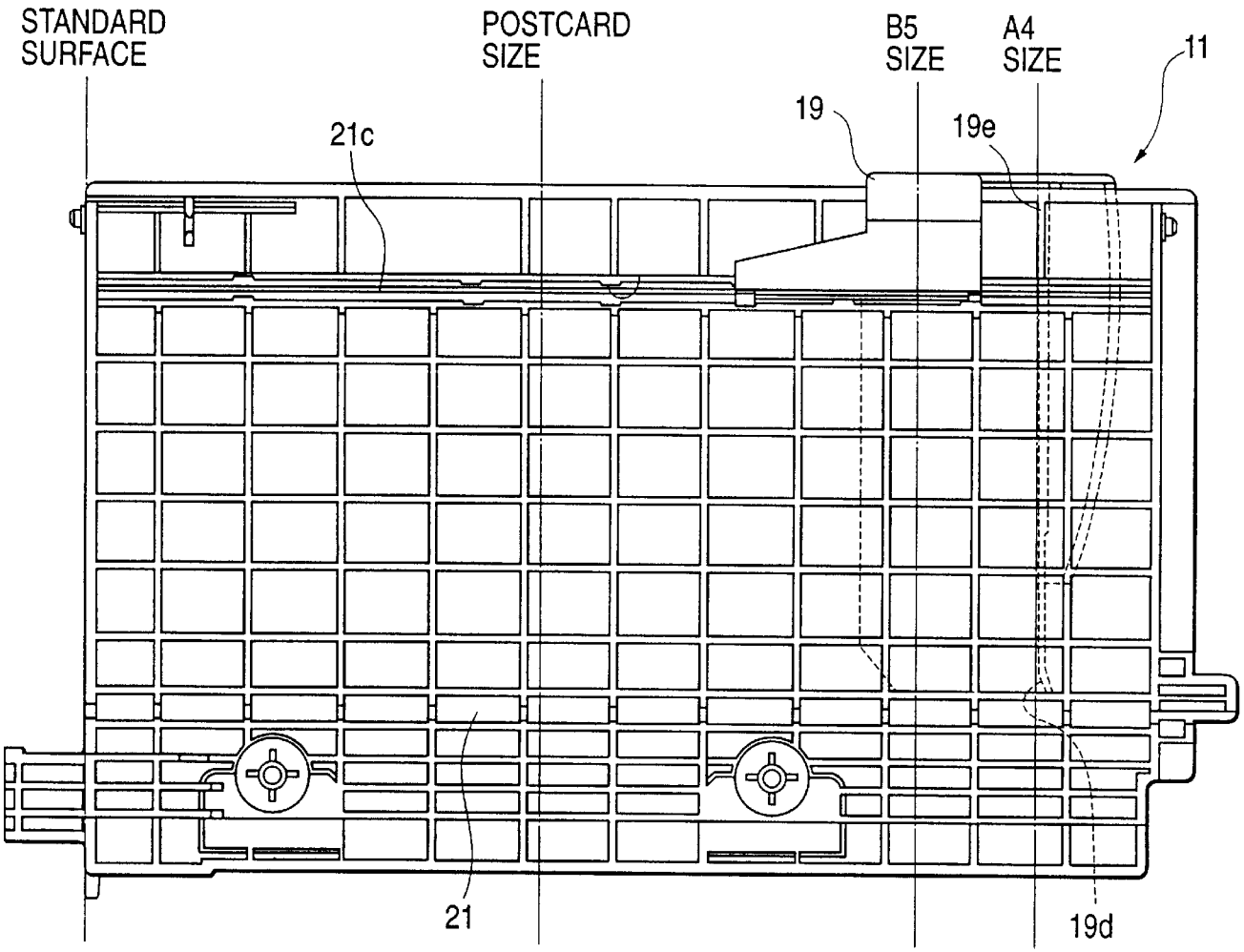
FIG. 11 is a rear view of a pressure plate having the movable side guide of FIG. 1 guiding the recording sheet having A4 size.
Figure 12:
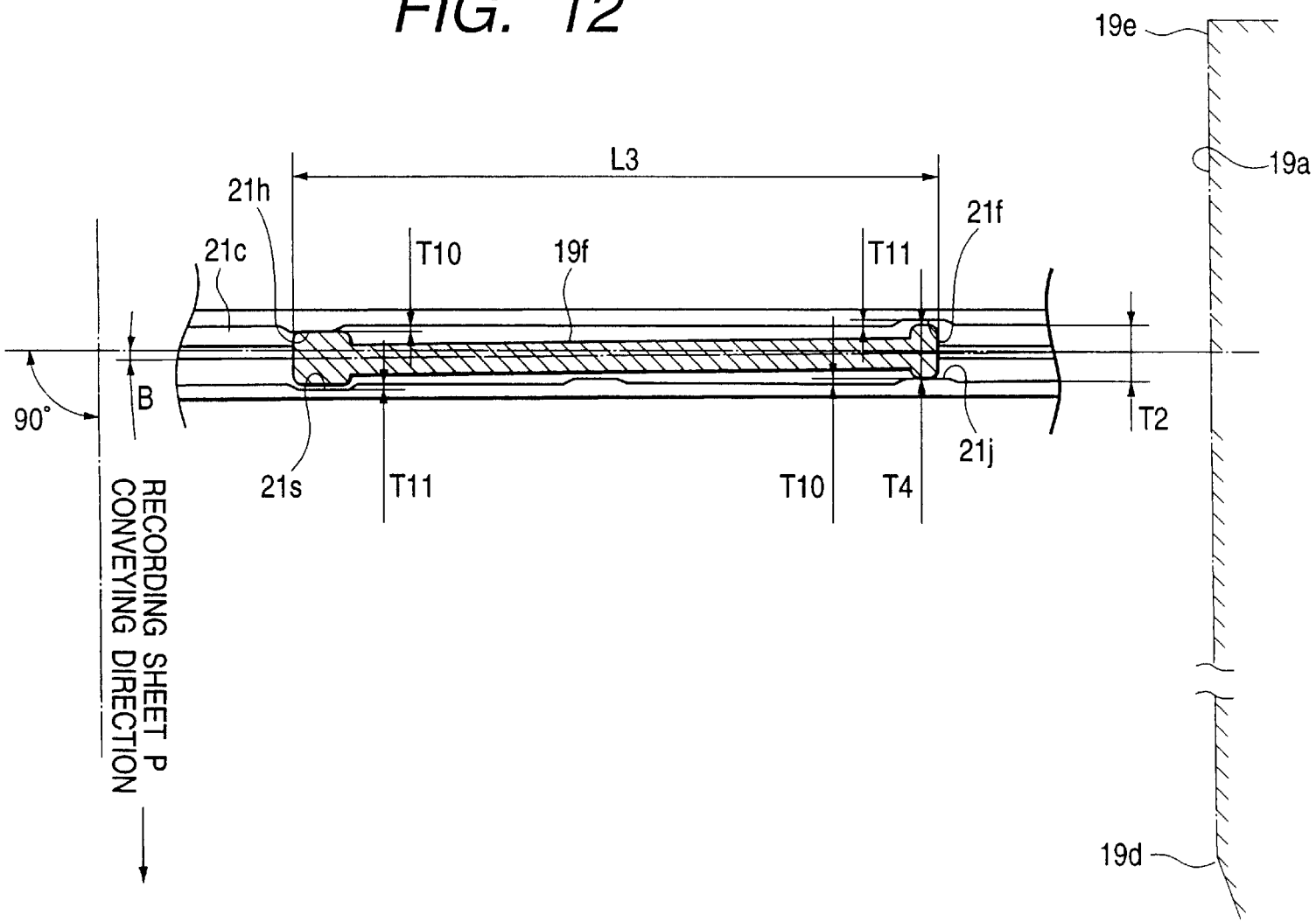
FIG. 12 is an enlarged view showing a condition that a slider (shown in section) is engaged by a rail in FIG. 11.

FIG. 11 is a rear view showing a positional relationship between the movable side guide 19 and the pressure plate 21 when the recording sheet P having A4 size is set, and FIG. 12 is a detailed view showing a relationship between the slider 19*f* and the protruded portions 21*h*, 21*j* and the recessed portions 21*s*, 21*t* in this case. The slider 19*f* is shown as a sectional view.

In FIG. 12, since the width T2 of the rail 21*c* is selected to 4.8 mm and the width T4 of the slider 19*f* is selected to 4.5 mm and the length L3 of the slider is selected to 54 mm, if there are no protruded portions, the slider 19*f* will be inclined by about ±0.3 degree at the maximum with respect to the line perpendicular to the recording sheet P2 conveying direction. That is to say, the recording sheet abutting surface 19*a* is inclined by about ±0.3 degree at the maximum with respect to the recording sheet P2 conveying direction.

Since the length L4 of the recording sheet abutting surface is selected to 106 mm, as mentioned above, depending upon the operator's manipulation, a great gap is created at the tail end portion 19*e*, with the result that the regulating effect of the movable side guide 19 cannot be achieved efficiently.

To avoid this, in the illustrated embodiment, the protruded portions 21*h*, 21*j* for the recording sheet having A4 size are provided so that the entire movable side guide 19 is rotated slightly in an anti-clockwise direction in FIG. 10 via the slider 19*f* regardless of the operator's manipulation to incline the recording sheet abutting surface 19*a* only in one direction. In the illustrated embodiment, since a protruded amount T10 of each of the protruded portions 21*h*, 21*j* is selected to 0.3 mm and a recessed amount of each of the recessed portions 21*s*, 21*t* is selected to 0.3 mm, the slider 19*f* and accordingly the recording sheet abutting surface 19*a* are inclined by an angle B (FIG. 12) of about 0.1 to about 0.5 degree toward a direction along which the tail end portion 19*e* abuts against the lateral edge of the recording sheet P2, with the result that, regardless of the operator's manipulation, the efficient regulating effect of the movable side guide 19 can be achieved, thereby preventing the skew-feeding of the recording sheet P2 having A4 size.

In FIGS. 14 to 16, the sheet feeding roller 5 is rotatably held by the base 20. The sheet feeding roller 5 is a plastic unitary part including a shaft portion 5*b* and roller portions 5*c*, and a sheet feeding roller rubber 6 for conveying the recording sheet P is provided around each of the roller portion 5*c*.

Each roller portion 5*c* has a D-shaped (i.e., semi-circular) cross-section, and sub-rollers 7 are arranged on both sides of the roller portion 5*c*. A radius of each sub-roller 7 is selected to be smaller than a radius of the sheet feeding roller rubber 6 attached to the sheet feeding roller 5 by about 0.5 mm to about 3 mm. Thus, when the sheet is not fed, the roller rubber 6 of the sheet feeding roller 5 does not contact with the recording sheet P, thereby preventing distortion of image and/or positional deviation of the sheet feeding roller 5.

Three roller portions 5*c* are provided on the shaft portion 5*b* in such a manner that they are spaced apart from the reference surface 20*b* by about 40 mm, about 90 mm and about 150 mm, respectively. Accordingly, the recording sheet having post card size is conveyed by two roller portions 5*c* near the reference surface 20*b*, the recording sheet having B5 or A4 size is conveyed by three roller portions 5*c*.

Figure 18:
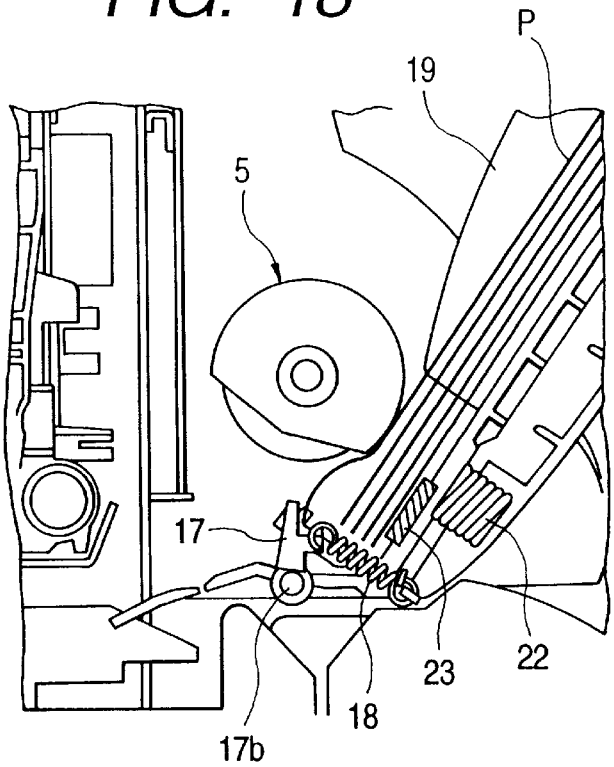
FIG. 18 is a sectional view of a separating portion when a thin recording sheet is fed.
Figure 19:
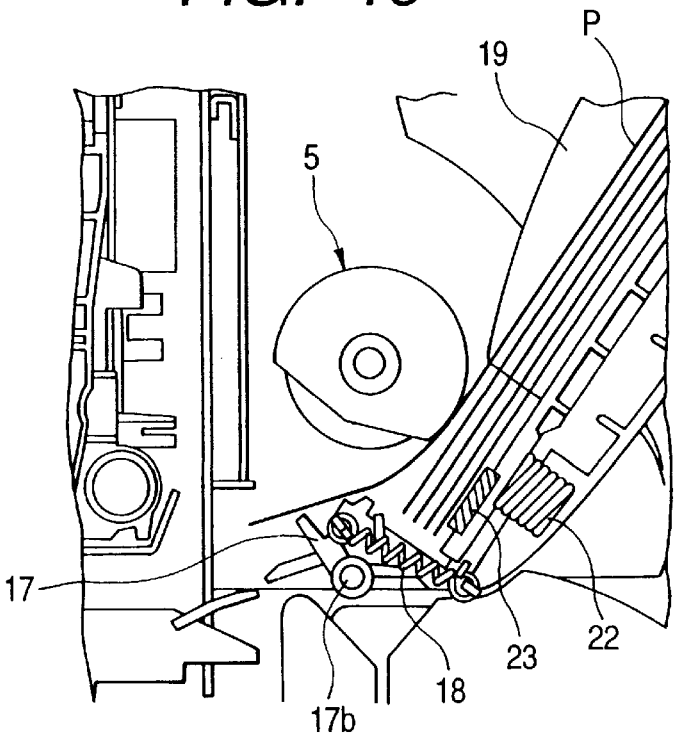
FIG. 19 is a sectional view of the separating portion when a thick recording sheet is fed.

In FIGS. 18 and 19, the separation claw 17 can be rotated around a center shaft 17*b* and is biased by a claw spring 18 toward the recording sheet P. Spring pressure of the claw spring 18 acting on the recording sheet is selected to about 10 to 50 grams. The separation claw 17 serves to separate the recording sheets when the recording sheet is fed and, as shown in FIG. 15, is disposed near the reference surface 20*b*.

As shown in FIG. 18, the recording sheets such as normal sheets are separated one by one by resistance of the separation claw 17. On the other hand, as shown in FIG. 19, regarding the recording sheet having great rigidity such as an envelope or a post card, since rigidity of the recording sheet overcomes the spring pressure of the claw spring 18, such a recording sheet is fed while laying the separation claw 17 down.

As mentioned above, according to the present invention, in the sheet feeding apparatus 11 comprising the pressure plate (sheet stacking means) 21, the sheet feeding roller (feeding means for separating and feeding the sheets stacked on the pressure plate one by one) 21, and the pair of side guides 19, 20*a* for guiding the lateral edges of the sheets during the separation and feeding, by changing the abutting position of the movable side guide 19 against the sheet in accordance with the size of the sheet, the width-wise regulation optimum to the sheet size can be achieved by the side guides regardless of the operator's manipulation, thereby preventing the skew-feeding of the sheet. Therefore, a sheet feeding apparatus having high quality and good operability can be provided.

Figure 20:
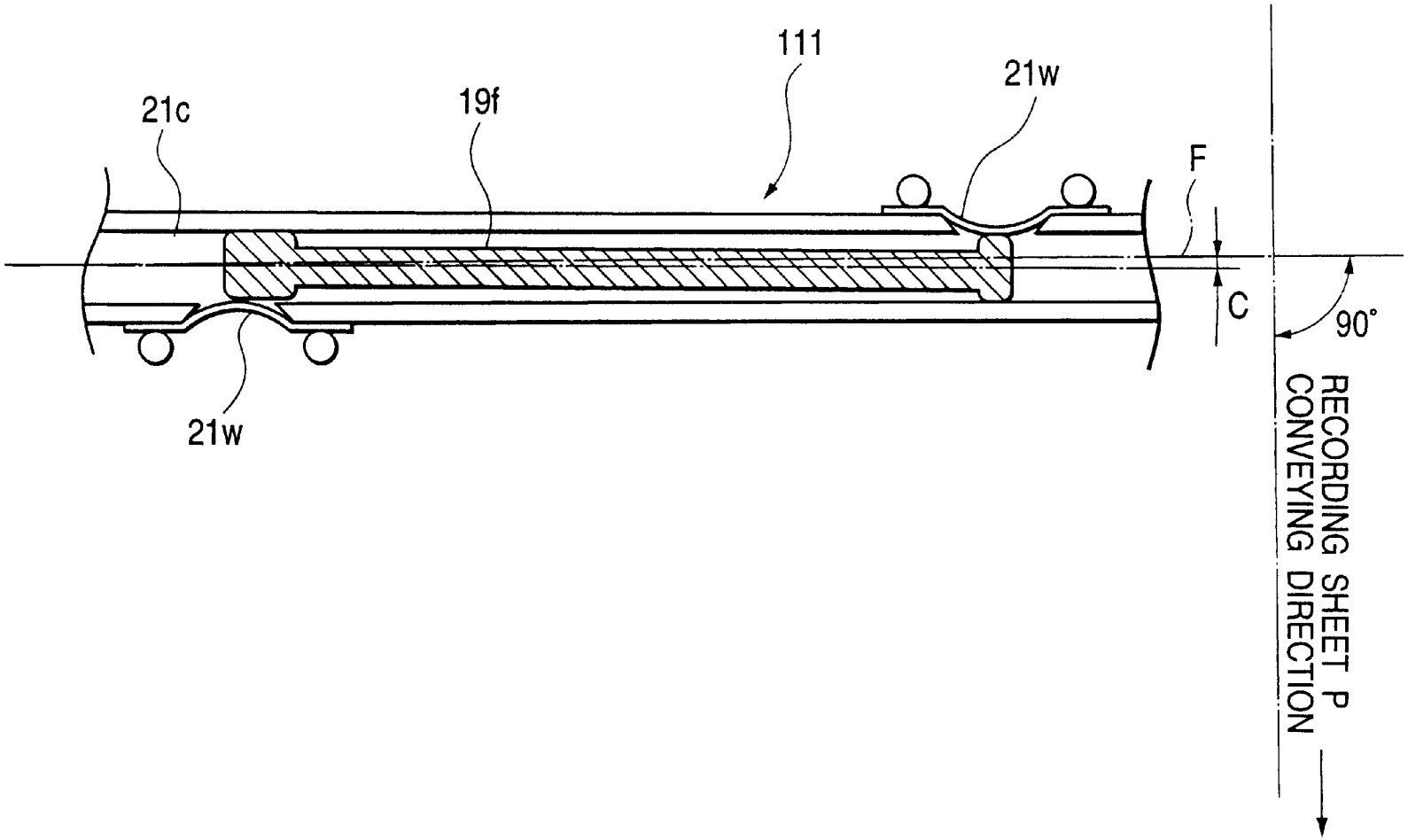
FIG. 20 is an enlarged view showing a condition that a slider (shown in section) is engaged by a rail in a sheet feeding apparatus according to a second embodiment of the present invention.

In place of the protruded portions 21*d* to 21*h* and 21*j* provided on the rail 21*c* of the pressure plate 21 in the first embodiment, as shown in FIG. 20, convex leaf springs 21*w* may be used. Each leaf spring 21*w* is made of SUS304CSPH and has a thickness of about 1 mm to about 0.5 mm.

FIG. 20 shows an arrangement for a recording sheet having post card size. In this arrangement, since a protruded amount of each leaf spring 21*w* is selected to about 0.3 mm, similar to the first embodiment, the slider 19*f* is inclined by an angle C of about 0.1 to 0.5 degree with respect to the line F perpendicular to the recording sheet P conveying direction. Accordingly, the recording sheet abutting surface 19*a* is inclined toward a direction along which the tip end portion 19*d* abuts against the lateral edge of the recording sheet P. Incidentally, regarding recording sheets having B5 and A4 sizes, the movable side guide 19 can be inclined similarly by the leaf springs. Since the other constructions are the same as those in the first embodiment, explanation thereof will be omitted.

In this sheet feeding apparatus 111, since the movable side guide 19 is forcibly inclined by the leaf springs 21*w* of a rail 121*c*, the recording sheet can positively be guided.

In the sheet feeding apparatus 11 according to the first embodiment, while an example that the angle of the recording sheet abutting surface 19*a* of the movable side guide 19 is changed in accordance with the size of the recording sheet by providing the protruded portions on the rail 21*c* of the pressure plate 21 was explained, a portion of the rail may be inclined with respect to the line F perpendicular to the recording sheet P conveying direction to achieve the same effect as the first embodiment.

Figure 21:
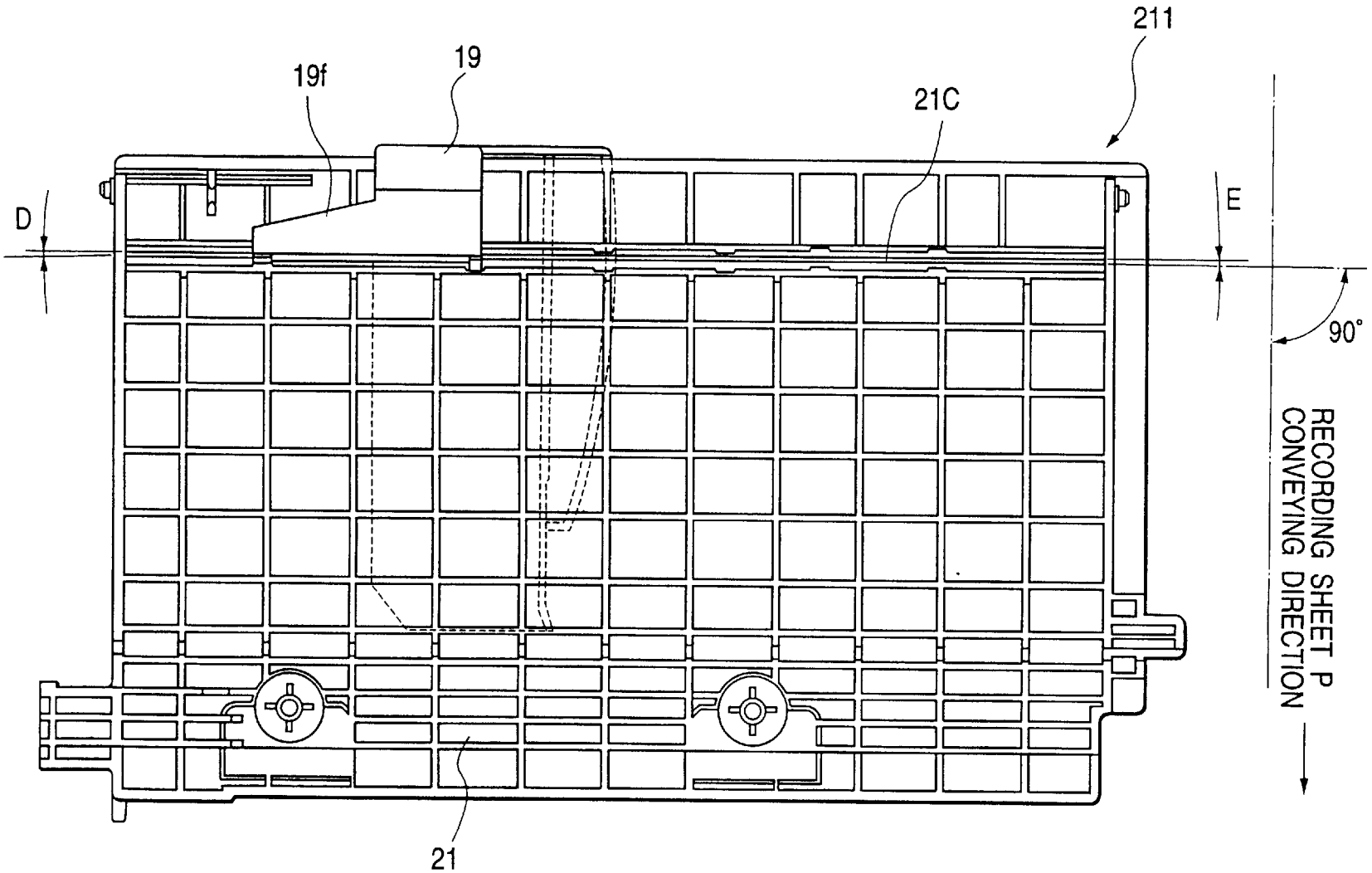
FIG. 21 is a rear view of a pressure plate into which a movable side guide is incorporated in a sheet feeding apparatus according to a third embodiment of the present invention.
Figure 22:
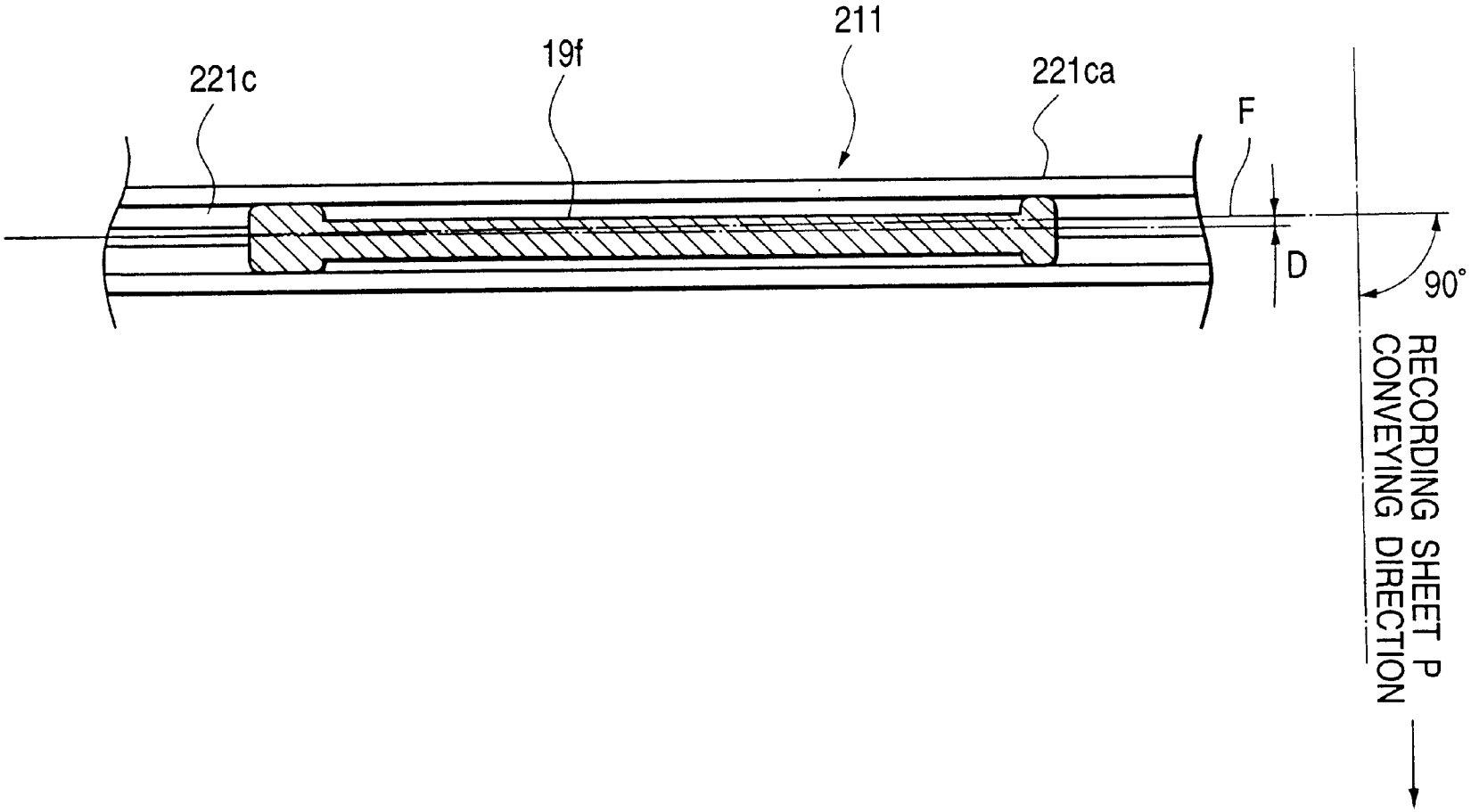
FIG. 22 is an enlarged view showing a condition that a slider (shown in section) is engaged by a rail in the sheet feeding apparatus according to the third embodiment.

FIG. 21 is a rear view showing a condition that the movable side guide 19 is incorporated into a pressure plate 221. In FIG. 22, a portion 221*ca* of a rail 221*c* of the pressure plate 221 is inclined by an angle D of about 0.3 degree to incline the slider 19*f* by an angle of about 0.1 to 0.5 degree with respect to the line F perpendicular to the recording sheet P conveying direction so that the tip end portion 19*d* of the movable side guide 19 abuts against the recording sheet P at a post card setting position as shown in FIG. 21.

At setting positions for recording sheets having A4 and B5 sizes, a portion 221*cb* of the rail 221*c* is inclined by an angle E of about 0.3 degree toward a direction opposite to the inclination direction regarding the post card. Since the other constructions are the same as those in the first embodiment, explanation thereof will be omitted.

This embodiment simplifies the configuration of the rail 221*c* to facilitate the control of dimension and improve productivity, as well as obtaining the same advantages as the first embodiment.

In the above-mentioned first to third embodiments, while examples that the rail 21*c*, 121*c* or 221*c* is formed on the pressure plate 21 and the slider 19*f* is formed on the movable side guide 19 were explained, the rail may be formed on the movable side guide 19 and the portion corresponding to the slider may be formed on the pressure plate 21. In this case, protruded portions, recessed portions or convex leaf springs are provided on the portion corresponding to the slider. Further, in the third embodiment, in place of inclination of the rail, it is required that the slider is inclined.

In the above-mentioned first to third embodiments, the fixed side guide may be replaced by a movable side guide. In this case, the pair of side guides are both movable, and, tip end portions or tail end portions of the movable side guides are approached to each other to guide the recording sheet.

What is claimed is:

1. A sheet feeding apparatus comprising:

sheet stacking means for supporting sheets;

sheet feeding means for feeding out the sheet supported by said sheet stacking means;

a pair of side guides having sheet abutting surfaces for regulating both lateral edges of the sheet supported by said sheet stacking means to guide the sheet in a sheet feeding direction when the sheet is fed out from said sheet stacking means by said sheet feeding means; and guide supporting means for supporting at least one of said pair of side guides for movement toward and away from the other side guide;

wherein said guide supporting means supports said side guide in such a manner that said sheet abutting surface is inclined with respect to the sheet feeding direction in accordance with a size of the sheet supported by said sheet stacking means.

2. A sheet feeding apparatus according to claim 1, wherein, when a sheet having a small size is supported by said sheet stacking means, said guide supporting means supports said side guide in an inclined condition so that a downstream end portion of said sheet abutting surface in the sheet feeding direction abuts against the sheet.

3. A sheet feeding apparatus according to claim 1, wherein, when a sheet having a large size is supported by said sheet stacking means, said guide supporting means supports said side guide in an inclined condition so that an upstream end portion of said sheet abutting surface in the sheet feeding direction abuts against the sheet.

4. A sheet feeding apparatus according to claim 2 or 3, wherein an inclination angle of said sheet abutting surface of said side guide is selected to 0.1 to 0.5 degree with respect to the sheet feeding direction.

5. A sheet feeding apparatus according to claim 1, wherein said guide supporting means includes a groove provided in one of said sheet stacking means and said side guide and extending in a direction perpendicular to the sheet feeding direction, and an engagement portion provided on the other of said sheet stacking means and said side guide and engaging with said groove, and further wherein protruded portions are provided on an inner surface of said groove at positions corresponding to sizes of various sheets so that said engagement portion is engaged with one of said protruded portions to incline said side guide.

6. A sheet feeding apparatus according to claim 5, wherein recessed portions are formed in an inner surface opposite to said protruded portions of said groove.

7. A sheet feeding apparatus according to claim 5, wherein, in a condition that said engagement portion is engaged with said protruded portion, said sheet abutting surface of said side guide is positioned in parallel with the sheet feeding direction.

8. A sheet feeding apparatus according to claim 1, wherein said guide supporting means includes a groove provided in one of said sheet stacking means and said side guide and extending in a direction perpendicular to the sheet feeding direction, and an engagement portion provided on the other of said sheet stacking means and said side guide and engaging with said groove, and further wherein elastic protruded members protruding toward said groove are provided on an inner surface of said groove at positions corresponding to sizes of various sheets so that said engagement portion is engaged with one of said elastic protruded members to incline said side guide.

9. A sheet feeding apparatus according to claim 1, wherein said guide supporting means includes a groove provided in one of said sheet stacking means and said side guide and extending in a direction perpendicular to the sheet feeding direction, and an engagement portion provided on the other of said sheet stacking means and said side guide and engaging by said groove, and further wherein said groove is partially inclined by a predetermined angle with respect to a direction perpendicular to the sheet feeding direction at positions corresponding to sizes of various sheets so that said engagement portion is engaged with the inclined groove to incline said side guide.

10. A sheet feeding apparatus according to claim 1, wherein said sheet stacking means has a pressure plate rockably supported by a frame, and said guide supporting means is provided on said pressure plate so that said side guide can be shifted along a sheet supporting surface of said pressure plate.

11. A sheet feeding apparatus according to claim 10, wherein one of said side guides is a fixed side guide having a separation claw for separating the sheets fed out by said sheet feeding means one by one, and said separation claw is rotatably supported so that said separation claw regulates a leading end corner of a sheet having small rigidity to separate the sheet and does not regulate a leading end corner of a sheet having great rigidity by being rotated by the sheet.

12. A sheet feeding apparatus comprising:

sheet stacking means for supporting sheets;

sheet feeding means for feeding out the sheet supported by said sheet stacking means;

a pair of side guides having sheet abutting surfaces for regulating both lateral edges of the sheet supported by said sheet stacking means to guide the sheet in a sheet feeding direction when the sheet is fed out from said sheet stacking means by said sheet feeding means; and guide supporting means for supporting at least one of said pair of side guides for movement toward and away from the other side guide;

wherein said guide supporting means supports said side guide in such a manner that said side guide is shifted in accordance with a size of the sheet supported by said sheet stacking means, and, in a position where said side guides are spaced apart, upstream end portions of said abutting surfaces in the sheet feeding direction are inclined toward a sheet abutting direction, and, in a position where said side guides are approached, downstream end portions of said abutting surfaces in the sheet feeding direction are inclined toward the sheet abutting direction.

13. A sheet feeding apparatus according to claim 12, wherein said guide supporting means includes a groove provided in one of said sheet stacking means and said side guide and extending in a direction perpendicular to the sheet feeding direction, and an engagement portion provided on the other of said sheet stacking means and said side guide and engaging with said groove, and further wherein protruded portions are provided on an inner surface of said groove at positions corresponding to sizes of various sheets so that said engagement portion is engaged with one of said protruded portions to incline said side guide.

14. A sheet feeding apparatus according to claim 12, wherein said guide supporting means includes a groove provided in one of said sheet stacking means and said side guide and extending in a direction perpendicular to the sheet feeding direction, and an engagement portion provided on the other of said sheet stacking means and said side guide and engaging with said groove, and further wherein elastic protruded members protruding toward said groove are provided on an inner surface of said groove at positions corresponding to sizes of various sheets so that said engagement portion is engaged with one of said elastic protruded members to incline said side guide.

15. A sheet feeding apparatus according to claim 12, wherein said guide supporting means includes a groove provided in one of said sheet stacking means and said side guide and extending in a direction perpendicular to the sheet feeding direction, and an engagement portion provided on the other of said sheet stacking means and said side guide and engaging by said groove, and further wherein said groove is partially inclined by a predetermined angle with respect to a direction perpendicular to the sheet feeding direction at positions corresponding to sizes of various sheets so that said engagement portion is engaged with the inclined groove to incline said side guide.

16. A sheet feeding apparatus according to claim 12, wherein an inclination angle of said sheet abutting surface of said side guide is selected to 0.1 to 0.5 degree with respect to the sheet feeding direction.

17. A sheet feeding apparatus according to claim 12, wherein said sheet stacking means has a pressure plate rockably supported by a frame, and said guide supporting means is provided on said pressure plate so that said side guide can be shifted along a sheet supporting surface of said pressure plate.

18. A sheet feeding apparatus according to claim 17, wherein one of said side guides is a fixed side guide having a separation claw for separating the sheets fed out by said sheet feeding means one by one, and said separation claw is rotatably supported so that said separation claw regulates a leading end corner of a sheet having small rigidity to separate the sheet and does not regulate a leading end corner of a sheet having great rigidity by being rotated by the sheet.

19. An image forming apparatus comprising:

sheet stacking means for supporting sheets;

sheet feeding means for feeding out the sheet supported by said sheet stacking means;

a pair of side guides having sheet abutting surfaces for regulating both lateral edges of the sheet supported by said sheet stacking means to guide the sheet in a sheet feeding direction when the sheet is fed out from said sheet stacking means by said sheet feeding means;

guide supporting means for supporting at least one of said pair of side guides for movement toward and away from the other side guide; and image forming means for forming an image on the sheet fed out from said sheet stacking means by said sheet feeding means;

wherein said guide supporting means supports said side guide in such a manner that said sheet abutting surface is inclined with respect to the sheet feeding direction in accordance with a size of the sheet supported by said sheet stacking means.

20. An image forming apparatus comprising:

sheet stacking means for supporting sheets;

sheet feeding means for feeding out the sheet supported by said sheet stacking means;

a pair of side guides having sheet abutting surfaces for regulating both lateral edges of the sheet supported by said sheet stacking means to guide the sheet in a sheet feeding direction when the sheet is fed out from said sheet stacking means by said sheet feeding means;

guide supporting means for supporting at least one of said pair of side guides for movement toward and away from the other side guide; and image forming means for forming an image on the sheet fed out from said sheet stacking means by said sheet feeding means;

wherein said guide supporting means supports said side guide in such a manner that said side guide is shifted in accordance with a size of the sheet supported by said sheet stacking means, and, in a position where said side guides are spaced apart, upstream end portions of said abutting surfaces in the sheet feeding direction are inclined toward a sheet abutting direction, and, in a position where said side guides are approached, downstream end portions of said abutting surfaces in the sheet feeding direction are inclined toward the sheet abutting direction.

* * * * *

UNITED STATES PATENT AND TRADEMARK OFFICE

CERTIFICATE OF CORRECTION

PATENT NO. : 6,170,817 B1
DATED : January 9, 2001
INVENTOR(S) : KoichiroKawaguchi It is certified that error appears in the above-identified patent and that said Letters Patent is hereby corrected as shown below:

Column 1,
Line 6, "sheet" should read -- sheets --.
Line 15, "sheet" should read -- sheets --.
Line 21, "is" should read -- are --.

Column 4,
Line 66, sub tray" should read -- sub-tray --.

Column 5,
Line 1, "sub tray" should read -- sub-tray --.
Line 4, "its upper both" should read -- both its upper --.

Column 7,
Line 62, "more should read -- further --.

Column 8,
Line 58, "portion 5c." should read -- portions 5c. --.

Column 10,
Line 31, "is" (2nd occurrence) should read -- be --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*